US005292001A

United States Patent [19]

Langenbeck et al.

[11] Patent Number: 5,292,001

[45] Date of Patent: Mar. 8, 1994

[54] NESTABLE STORAGE AND TRANSPORT TRAY

[75] Inventors: Keith A. Langenbeck, 4005 University Blvd., Dallas, Tex. 75205; Jesse P. Kensinger, Richardson, Tex.

[73] Assignee: Keith A. Langenbeck, Dallas, Tex.

[21] Appl. No.: 689,458

[22] Filed: Apr. 22, 1991

Related U.S. Application Data

[63] Continuation-in-part of Ser. No. 435,540, Sep. 26, 1989, Pat. No. 5,009,053.

[51] Int. Cl.[5] ..... B65D 21/04

[52] U.S. Cl. ..... 206/518; 206/519

[58] Field of Search ..... 206/518, 519

[56] References Cited

U.S. PATENT DOCUMENTS

| | | | |
|---|---|---|---|
| 2,181,150 | 11/1939 | Pittenger . | |
| 2,758,742 | 8/1956 | Farrell . | |
| 2,918,379 | 12/1959 | Lurie . | |
| 3,117,692 | 1/1964 | Carpenter et al. . | |
| 3,130,860 | 4/1964 | Oberkircher . | |
| 3,376,046 | 4/1968 | Kivett et al. . | |
| 3,419,184 | 12/1968 | Asenbauer . | |
| 3,464,832 | 9/1969 | Mullinix . | |
| 3,642,168 | 2/1972 | Wiley, Jr. et al. | 206/518 |
| 3,794,208 | 2/1974 | Roush et al. | 206/518 |
| 4,096,947 | 6/1978 | Morse | 206/519 |
| 4,113,095 | 9/1978 | Dietz et al. | 206/518 |
| 4,195,746 | 4/1980 | Cottrell . | |
| 4,298,156 | 11/1981 | Reifers | 206/518 |
| 4,316,540 | 2/1982 | Lapham | 206/518 |
| 4,523,692 | 6/1985 | Lemkin . | |
| 4,593,816 | 6/1986 | Langenbeck | 206/518 |
| 4,616,762 | 10/1986 | Alexandrer | 206/518 |
| 4,753,351 | 6/1988 | Guillin | 206/518 |
| 4,932,532 | 6/1990 | Apps et al. . | |
| 4,962,854 | 10/1990 | Ricci | 206/518 |
| 5,031,774 | 7/1991 | Morris | 206/518 |

FOREIGN PATENT DOCUMENTS 2136399 9/1984 United Kingdom .

*Primary Examiner*—Joseph Man-Fu Moy
*Attorney, Agent, or Firm*—W. Kirk McCord

[57] ABSTRACT

A tray for storing articles, such as cylindrical beverage containers, in a substantially upright position includes a bottom member and four wall members interconnected to provide an enclosure for receiving the articles. Each of the wall members has a support member protruding into the enclosure from the corresponding wall member. Each support member has a support surface which is inclined upwardly from the corresponding wall member into the enclosure. A portion of the outer surface of the bottom member adjacent to each of the wall members is also inclined upwardly and is adapted to contact the corresponding support surfaces of another tray when two or more trays are nested. A plurality of external rib members are disposed on respective outer surfaces of the wall members for contacting respective inner surfaces of the wall members of another tray when two or more trays are nested. The engagement between the external rib members of the inner tray and the inner wall surfaces of the outer tray aligns the respective top rim members of the nested trays along respective vertical axes and provides sufficient spacing between the nested trays to prevent the trays from "locking" or sticking together.

10 Claims, 30 Drawing Sheets

NESTABLE STORAGE AND TRANSPORT TRAY

BACKGROUND OF THE INVENTION

This is a continuation-in-part of co-pending U.S. patent application Ser. No. 07/435,540, filed Sep. 26, 1989, now U.S. Pat. No. 5,009,053.

FIELD OF INVENTION

The present invention relates generally to storage and transport trays and in particular to nestable trays for storing and transporting articles, such as beverage containers.

Beverages, such as soft drinks and beer, are distributed commercially in glass and plastic bottles and in aluminum cans. Single service beverage containers, which typically contain six to twenty-four ounces of the beverage, are grouped into individual cases, each of which contains twenty-four individual containers. These cases may be further subdivided into groups of six, eight or twelve individual beverage container packages. Typically, each case of individual containers or multiple container packages is loaded by an automated tray packing system into a separate tray for transport from the site of a bottling company to the point of sale, such as at a grocery store.

According to prior practice, trays used for transporting beverage containers are made of corrugated paper or wood. Corrugated paper trays are typically rectangular in shape, with upright walls around the perimeter of the tray. Thus, the beverage containers must be loaded vertically into the tray, which is a relatively slow and complex process. Alternatively, if the containers are loaded into the corrugated paper tray when the tray is disposed at an angle relative to the incoming containers, the volume of the tray must be substantially greater than the volume occupied by the containers when the containers are loaded into the tray, thereby resulting in excessive free play or "slop" among the containers in the tray after loading.

Another problem associated with corrugated paper trays is their lack of durability. Such trays are usually discarded after one trip from the bottling company to the point of sale. Because these trays are "non-returnable", the cost of the bottling operation is increased by approximately $0.07 per tray, which can be substantial for a large bottling company shipping millions of beverage cases per year.

Wood trays are typically of older design and are more suitable for transporting bottles than cans. Such wood trays may have individual rectangular compartments within the tray for receiving an individual bottle. Because of the thickness of the wooden partitions between compartments, such wooden trays are typically used only to transport individual bottles and not beverage containers which have been pre-packaged or prewrapped into groups of six, eight or twelve individual containers. Because the spacing between individual containers is different when wooden transport trays are used instead of corrugated paper trays, the automatic tray packing system must be adjusted for a different setting, which complicates and slows down the packing process. Although wood transport trays are returnable, they have vertically upright walls, which prevent them from being "nested" together to save storage space.

SUMMARY OF THE INVENTION

In accordance with the present invention, a tray is provided for storing articles, such as cylindrically-shaped beverage containers, in a substantially upright position. The tray includes a bottom member and four wall members interconnected to provide an enclosure for receiving the articles. Each of the wall members has a predetermined draft angle to allow the bottom member and substantial portions of the wall members of a first tray to be received within the enclosure of a second tray, whereby a plurality of trays can be nested together.

In accordance with a unique feature of the invention, each of the wall members has a support member protruding into the enclosure from the corresponding wall member. Each support member has an upwardly facing support surface intermediate a top portion of the tray and the bottom member for supporting a bottom member of another tray in an intermediate nested position between the top portion and the bottom member. Each of the wall members further includes a rib member protruding into the enclosure from the corresponding wall member. Each of the rib members extends between the top portion and the corresponding support surface. Each of the wall members further includes a recess formed in an external surface of the corresponding wall member. Each of the recesses extends from the bottom member at least partially upwardly along the corresponding wall member and is adapted to receive a corresponding one of the rib members when two trays are nested, to allow the bottom member of an inner tray in a nested configuration to contact the support surfaces of an outer tray in the nested configuration.

In accordance with another unique feature of the invention, each of the support members has a substantially half-conical shape, which is truncated to define the corresponding support surface. Each of the rib members is substantially wedge-shaped and extends downwardly and inwardly from the top portion of the tray, terminating at the corresponding support surface. In one embodiment, selected ones of the recesses include divider means extending from the bottom member at least partially upwardly along the corresponding wall member for partitioning each of the selected ones of the recesses to form corresponding slots. Each of the slots is adapted to receive a corresponding rib member when two trays are nested. Each of the rib members has sufficient relief to allow a bottom surface of the corresponding divider means to contact the corresponding support surface. In another embodiment, a portion of the corresponding wall member defining each recess other than the selected ones of the recesses is spaced apart from the rib member received within the corresponding recess when the two trays are nested, to accommodate the insertion of an object between the portion of the corresponding wall member and the corresponding rib member, to facilitate handling of nested trays.

In accordance with yet another unique feature of the invention, the tray further includes a plurality of spacer members on respective outer surfaces of the wall members. Respective inner surfaces of the wall members of the outer tray in the nested configuration are positionable in contact with the corresponding spacer members of the inner tray in the nested configuration, to provide spacing between the inner and outer trays in the nested configuration.

In accordance with a further unique feature of the invention, each of the support surfaces is inclined upwardly in a direction from the corresponding wall member into the tray enclosure. A portion of an outer surface of the bottom member proximate to each of the wall members is inclined upwardly in an inward direction. The inclined portion of the bottom member is adapted to contact the corresponding support surfaces of another tray when two trays are nested.

DETAILED DESCRIPTION OF THE PREFERRED EMBODIMENT

Figure 1:
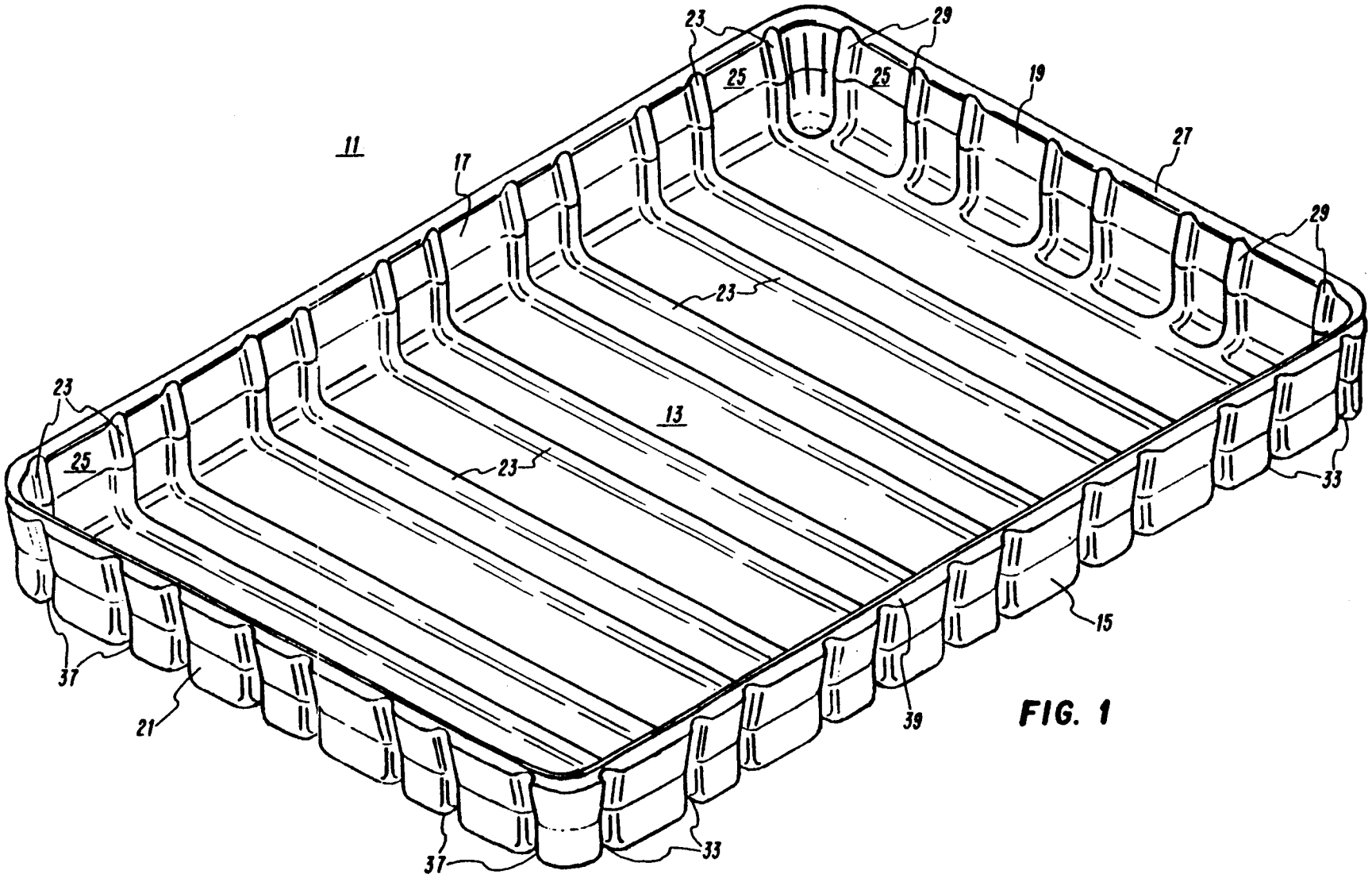
FIGS. 1–4 are perspective, side elevation, end elevation and top plan views, respectively, of a first embodiment of a tray for storing and transporting beverage containers and the like, according to the present invention.

In the description which follows, like parts are marked throughout the specification and drawings, respectively. The drawings are not necessarily to scale and in some instances proportions have been exaggerated in order to more clearly depict certain features of the invention.

Referring to FIGS. 1–4, a first embodiment of a storage and transport tray 11 according to the present invention is depicted. Tray 11 is comprised of a bottom member 13, a pair of oppositely positioned side walls 15 and 17 and a pair of oppositely positioned end walls 19 and 21, interconnected to form an enclosure for receiving articles therein. The respective intersections between adjacent ones of the tray walls and between each of the walls and bottom member 13 define respective curved surfaces to provide respective areas of transition therebetween, thereby enhancing the strength and rigidity of tray 11.

Disposed on respective inner surfaces of side walls 15 and 17 and on bottom member 13 are a first set of rib members 23. First rib members 23 are arranged in cooperating pairs to define respective recessed regions 25 therebetween. The spacings between adjacent ones of rib members 23 are dependent upon the thickness of rib members 23 (measured perpendicularly inward from the respective side walls 15 and 17) and the diameter of the container. The greater the thickness of rib members 23, the greater will be the spacings between adjacent ones of the rib members, so that cylindrically-shaped articles, such as beverage containers, stored in tray 11 are able to contact the respective side walls 15 and 17 within the respective recessed regions 25, as will be described in greater detail with reference to FIGS. 25–28.

First rib members 23 extend substantially along the entire height of side wall 15, transversely across bottom member 13 and substantially along the entire height of opposite side wall 17 and terminate at respective intersections with a perimeter rim member 27, which is disposed adjacent to the upper edge of tray 11. Rim member 27 extends inwardly from each of the walls of tray 11 along the perimeter thereof, to enhance the structural strength and rigidity of the upper edges of tray 11.

Figure 4:
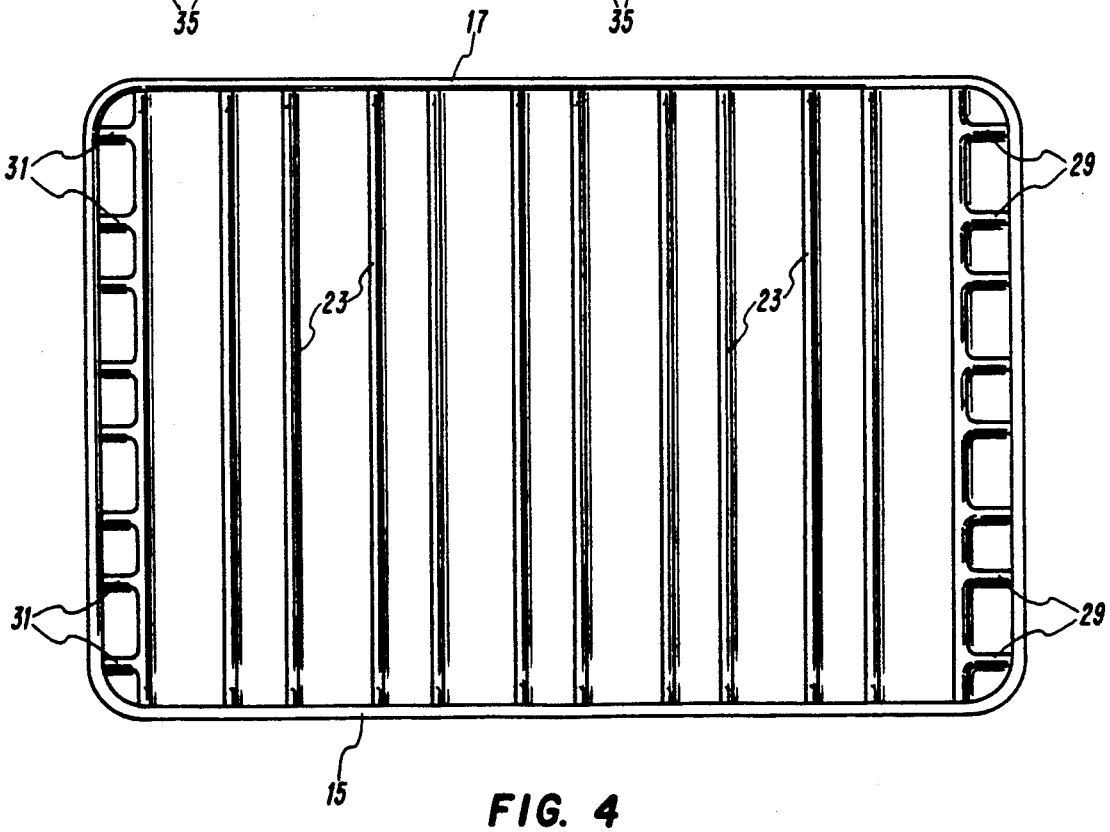

A second set of rib members 29 is disposed on an inner surface of end wall 19 and extends substantially along the entire height of end wall 19 and partially inwardly along bottom member 13 and terminating at the respective intersections on bottom member 13 with the particular one of the first set of rib members 23 which is closest to end wall 19. A third set of rib members 31 is disposed on an inner surface of end wall 21 and extends substantially along the entire height of end wall 21 and partially inwardly along bottom member 13 and terminating at the respective intersections on bottom member 13 with the particular one of the first set of rib members 23 which is closest to end wall 21, as shown in FIG. 4.

Second and third rib members 29 and 31 are also arranged in respective cooperating pairs at predetermined locations on tray 11. Each of the cooperating pairs defines a corresponding one of a plurality of recessed regions 25 therebetween, in much the same manner as first rib members 23. The spacings between adjacent ones of rib member 29 and 31 along the respective end walls 19 and 21 are dependent upon the thickness of the rib members (measured perpendicularly inward from the respective end walls) and the diameter of the container. The greater the thickness of the rib members, the greater will be the spacing between adjacent ones of rib members 29 and 31, so that cylindrically-shaped articles, such as beverage containers, stored in tray 11 are able to contact the respective end walls 19 and 21 within the respective recessed regions 25, as will be described in greater detail with reference to FIGS. 25–28. One skilled in the art will appreciate that second and third rib members 29 and 31 are in effect a mirror image of one another.

Bottom member 13, side walls 15 and 17, end walls 19 and 21, rim member 27 and first, second and third rib members 23, 29 and 31 are preferably formed as an integral unit using a conventional thermoforming process. Tray 11 is preferably comprised of a lightweight, translucent plastic material. Each rib member of tray 11 forms a corresponding groove in the corresponding outer surface of tray 11. First rib members 23 form a corresponding first set of grooves 33 in the respective outer surfaces of side walls 15 and 17 and in bottom member 13. Second and third rib members 29 and 31 form corresponding second and third sets of grooves 35 and 37 in respective outer surfaces of end walls 19 and 21 and in bottom member 13. Rim member 27 forms a corresponding groove 39 in the respective outer surfaces around the perimeter of tray 11.

Figure 2:
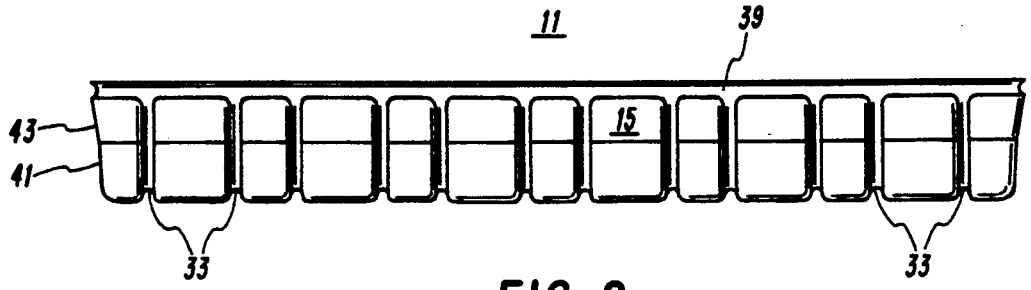
Figure 3:
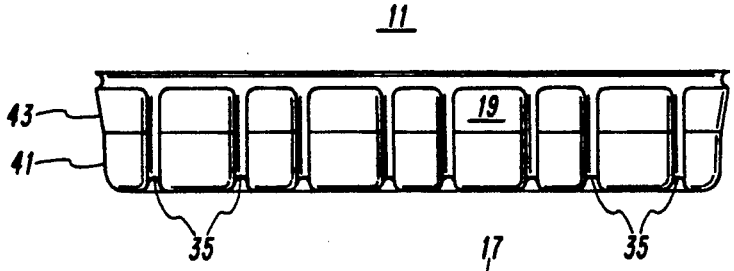

Tray 11 is particularly well-suited for storing and transporting cylindrically-shaped articles, such as beverage container bottles or cans, in a substantially upright position, without excessive free play or "slop" of the beverage containers within tray 11. Side walls 15 and 17 and end walls 19 and 21 are preferably "compound" walls, the respective lower portions 41 of which are oriented substantially vertically and the respective upper portions 43 of which are angled outwardly with respect to lower portions 41 (as best seen in FIGS. 2 and 3), to provide a predetermined draft angle to facilitate loading of beverage containers into tray 11.

Figure 5:
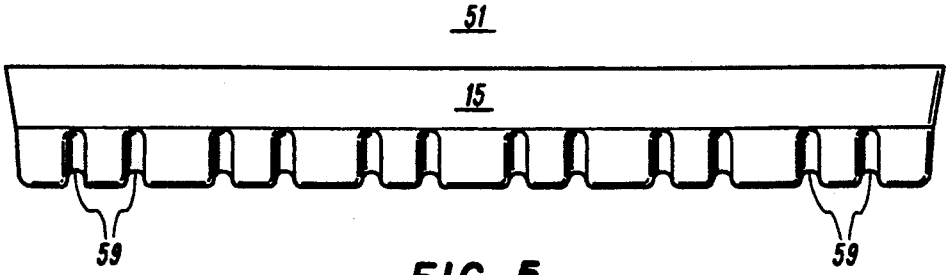
FIGS. 5–7 are side elevation, end elevation and top plan views, respectively, of a second embodiment of a tray, according to the present invention.
Figure 6:
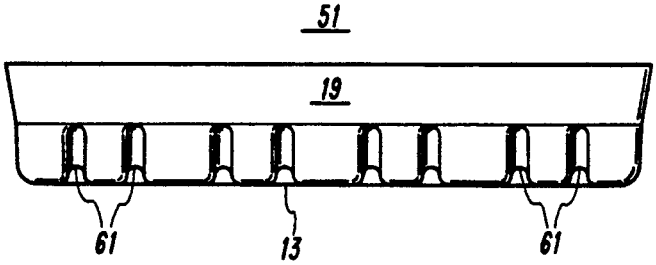
Figure 7:
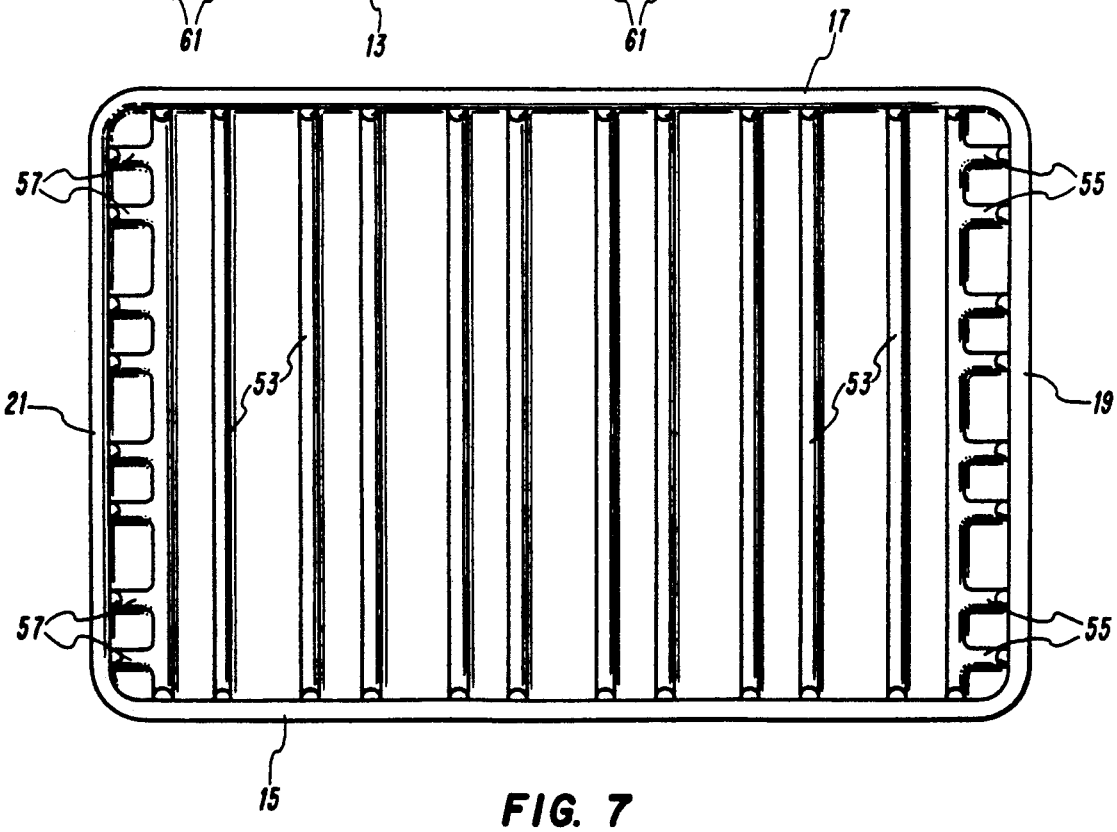

Referring to FIGS. 5–7, a second embodiment of a tray 51 according to the present invention is depicted. Tray 51 is substantially the same as tray 11, described above with reference to FIGS. 1–4, except that first, second and third sets of rib members 53, 55 and 57 extend only partially upward along respective side walls 15 and 17 and end walls 19 and 21 and tray 51 contains no perimeter rim member, as best seen in FIGS. 5 and 6. First, second and third sets of rib members 53, 55 and 57 preferably extend vertically along substantially the entire height of the respective lower portions 41 of the compound walls of tray 51 and terminate at or adjacent to the area of transition between the respective lower portions 41 and upper portions 43 of the tray walls, as best seen in FIGS. 5 and 6. First, second and third rib members 53, 55 and 57 form corresponding first, second and third sets of grooves in the respective outer surfaces of tray 51. First and second sets of grooves 59 and 61 are illustrated in FIGS. 5 and 6.

Figure 8:
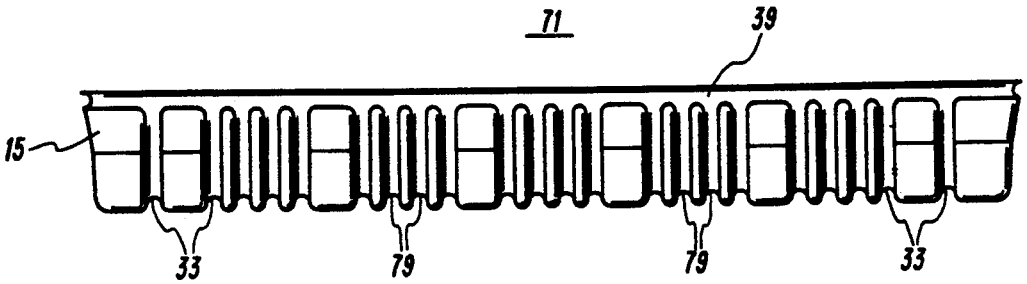
FIGS. 8–10 are side elevation, end elevation and top plan views, respectively, of a third embodiment of a tray, according to the present invention.
Figure 9:
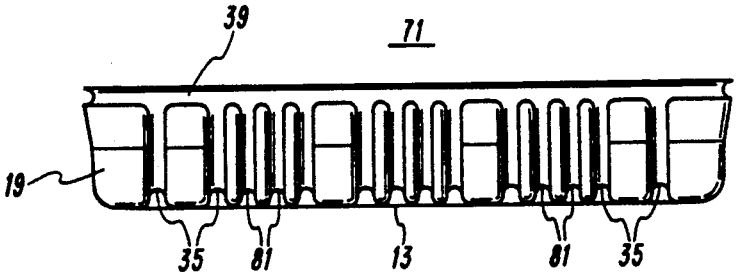
Figure 10:
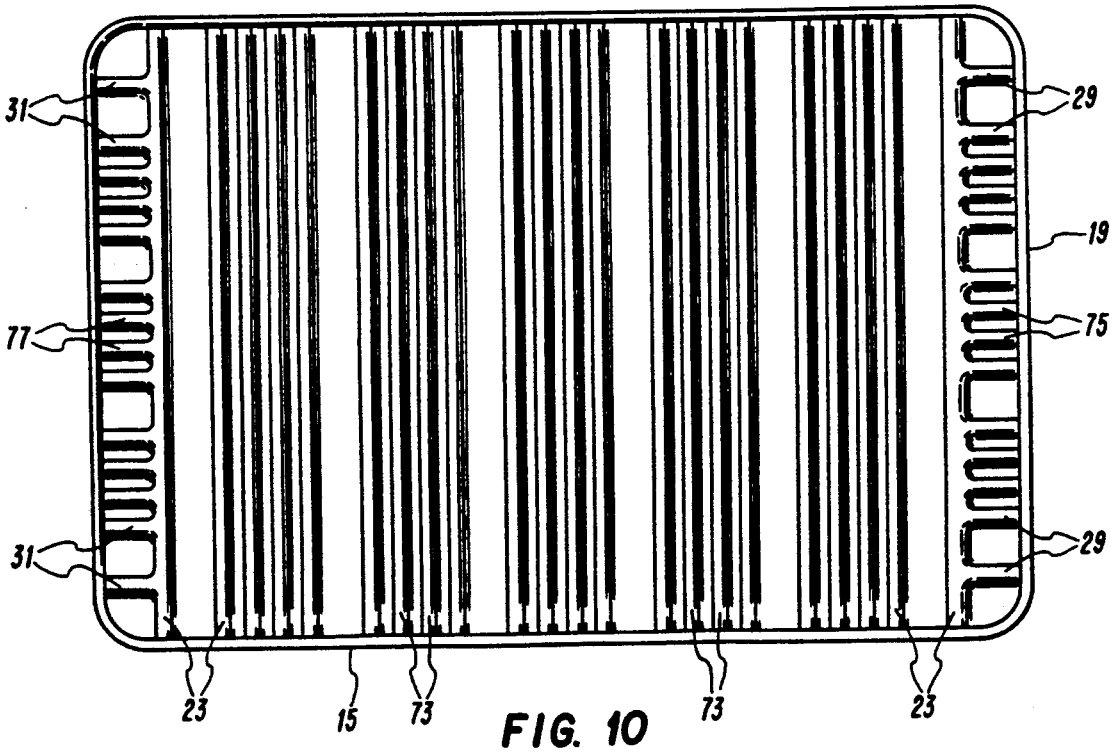

Referring to FIGS. 8–10 a third embodiment of a tray 71 according to the present invention is depicted. Tray 71 is substantially the same as tray 11 described above with reference to FIGS. 1–4, except that tray 71 further includes a fourth set of rib members 73 extending vertically along substantially the entire height of first side wall 15, transversely across bottom member 13 and vertically along substantially the entire height of second side wall 17, and fifth and sixth sets of rib members 75 and 77 extending vertically along substantially the entire height of respective first and second end walls 19 and 21 and partially inwardly along bottom member 13 and terminating at the respective intersections on bottom member 13 with respective ones of first rib members 23 which are closest to the respective first and second end walls 19 and 21. Fourth, fifth and sixth sets of rib members 73, 75 and 77 are disposed at substantially equal intervals between the respective adjacent cooperating pairs of rib members 23, 29 and 31 on the respective walls of tray 71. Fourth, fifth and sixth sets of rib members 73, 75 and 77 form corresponding fourth, fifth and sixth sets of grooves in the respective outer surfaces of tray 71. Fourth and fifth sets of grooves 79 and 81 are illustrated in FIGS. 8 and 9.

Figure 11:
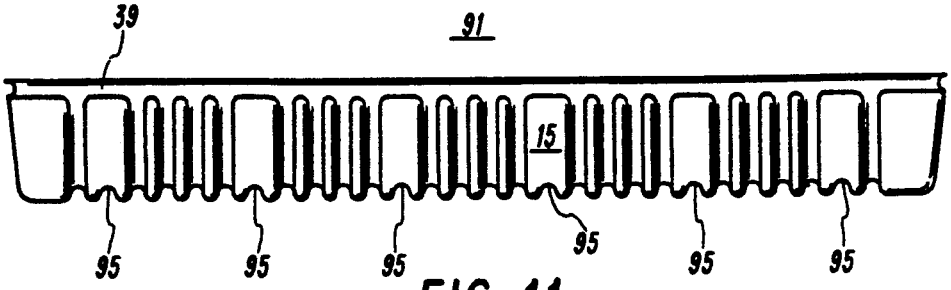
FIGS. 11–13 are side elevation, end elevation and top plan views, respectively, of a fourth embodiment of a tray, according to the present invention.
Figure 12:
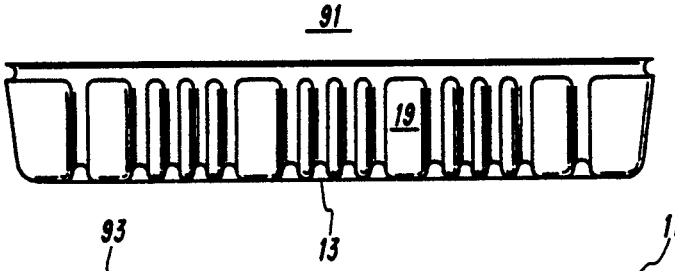
Figure 13:
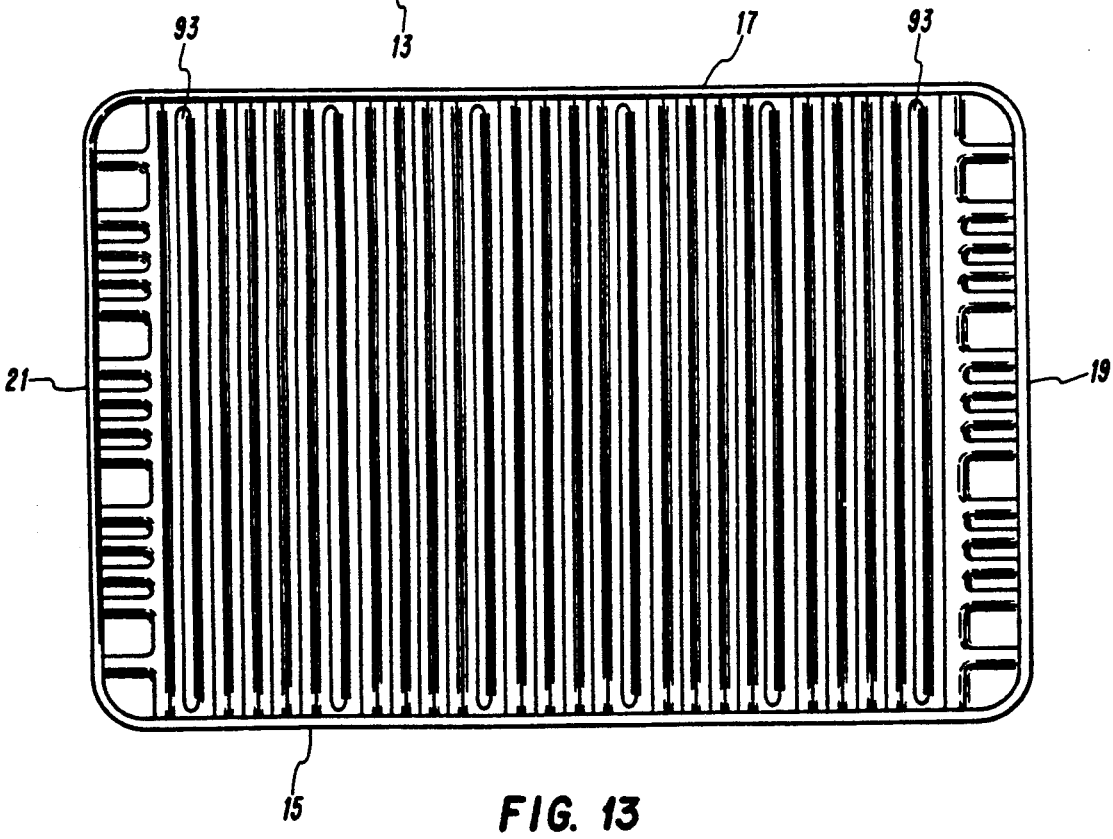
Figure 14:
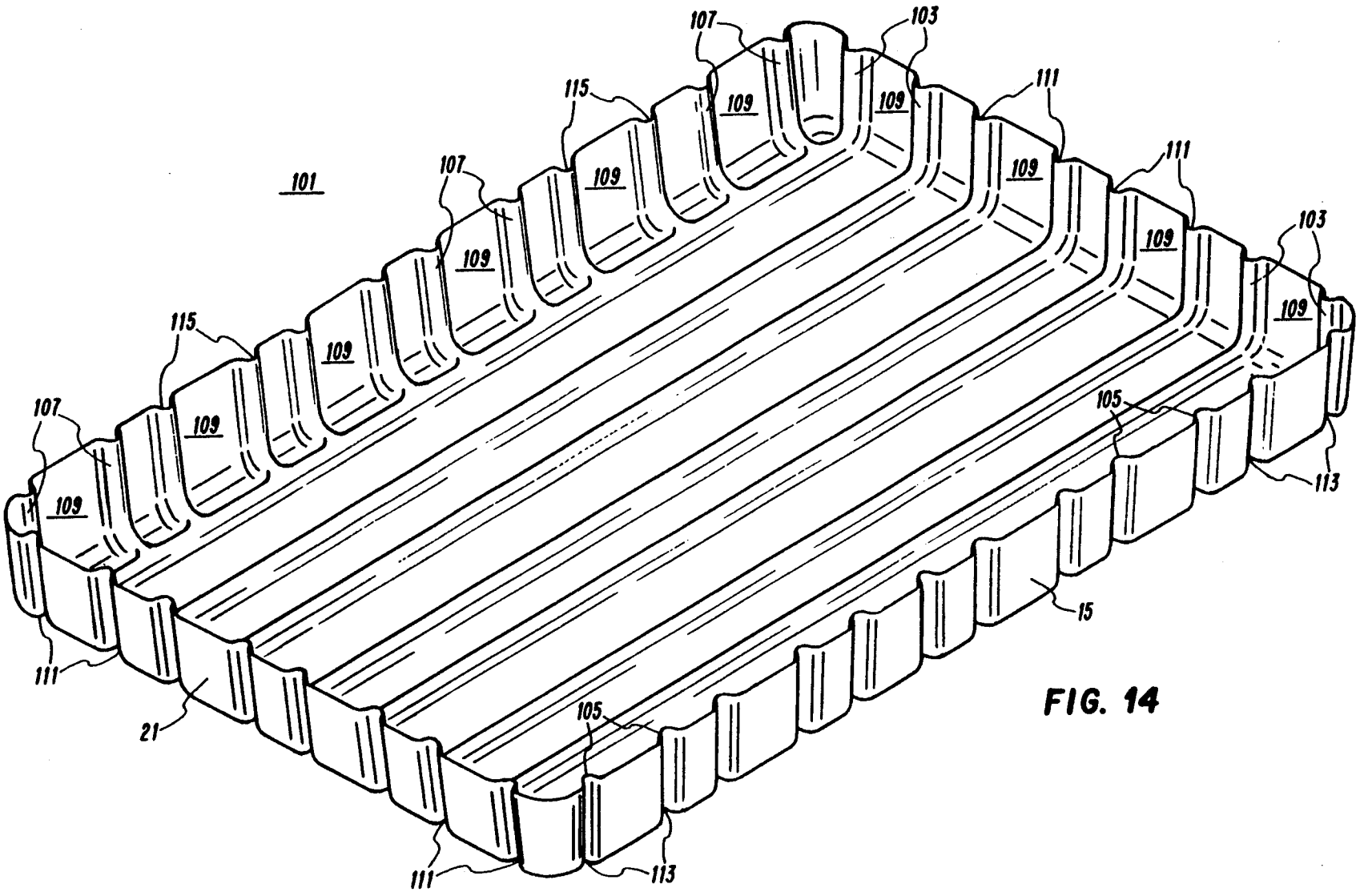
FIGS. 14–17 are perspective, side elevation, end elevation and top plan views, respectively, of a fifth embodiment of a tray, according to the present invention.
Figure 15:
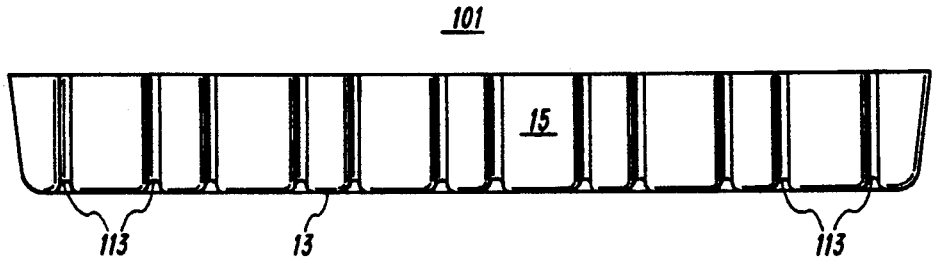
Figure 16:
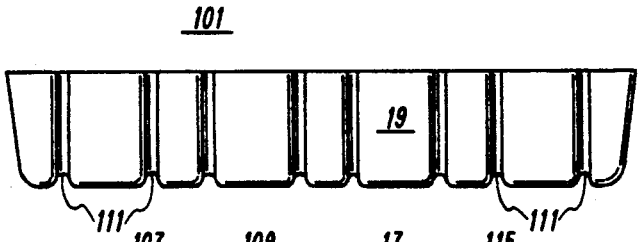
Figure 17:
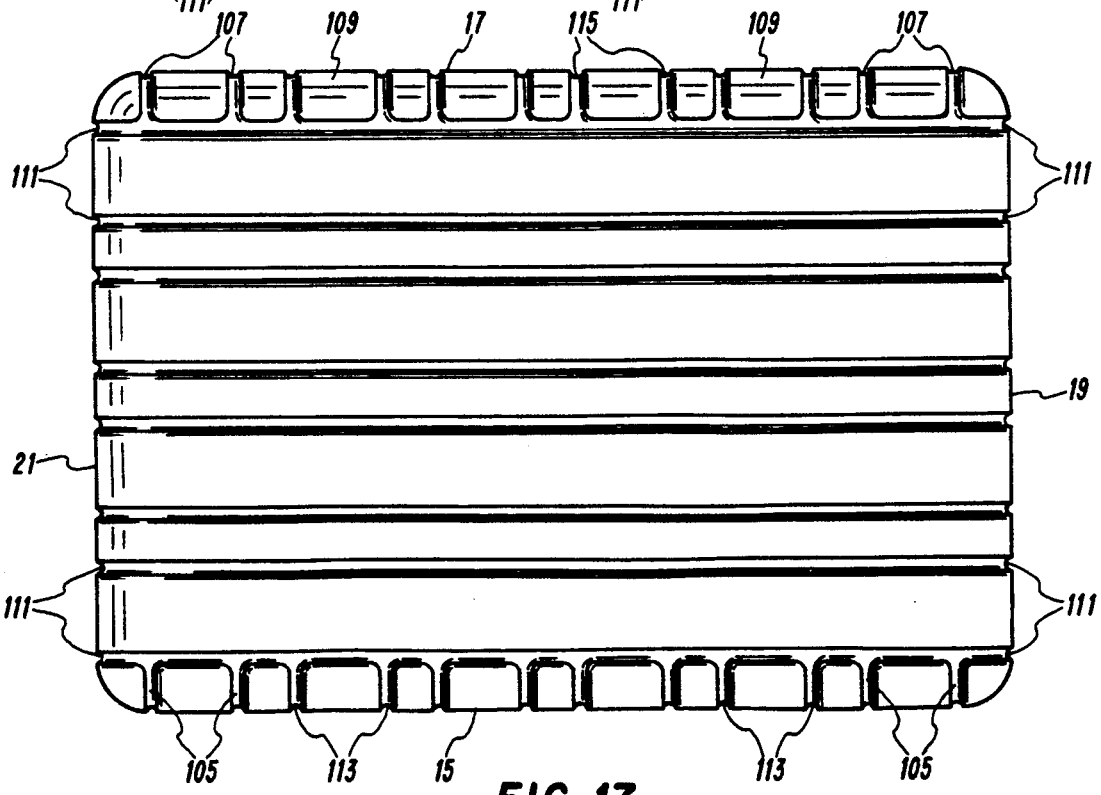

Referring to FIGS. 11–13, a fourth embodiment of a tray 91 according to the present invention is depicted. Tray 91 is substantially the same as tray 71 described above with reference to FIGS. 8–10, except that tray 91 further includes a seventh set of rib members 93 extending transversely across bottom member 13 between first and second side walls 15 and 17 and walls 15, 17, 19 and 21 are "single slope" walls (i.e., the walls have a relatively constant slope from bottom member 13 to rim member 17) instead of "compound" walls. Seventh rib members 93 do not extend vertically along the respective surfaces of side walls 15 and 17, but rather terminate at the respective intersections with side walls 15 and 17. Seventh set of rib members 93 are disposed between individual ones of each cooperating pair of first set of rib members 23, at substantially equal distances between individual rib members 23 of each cooperating pair, for dividing the corresponding recessed region 25 substantially in half along bottom member 13. Seventh set of rib members 93 form a corresponding seventh set of grooves 95 on the outer surface of bottom member 13, as best seen in FIG. 11.

Referring to FIGS. 14–17, a fifth embodiment of a tray 101 according to the present invention is depicted. Tray 101 has a first set of rib members 103 extending vertically along substantially the entire height of first end wall 19, longitudinally along bottom member 13 and vertically along substantially the entire height of second end wall 21. First rib members 103 terminate at the respective upper edges of first and second end walls 19 and 21.

Second and third sets of rib members 105 and 107 extend vertically along substantially the entire height of respective first and second side walls 15 and 17 and partially inwardly across bottom member 13 and terminate at the respective intersections on bottom member 13 with a particular one of first set of rib members 103 which is closest to the respective side walls 15 and 17.

First, second and third sets of rib members 103, 105 and 107 are arranged in respective cooperating pairs at predetermined locations on tray 101. Each of the cooperating pairs of rib members defines a corresponding one of a plurality of recessed regions 109 therebetween. The spacings between adjacent ones of rib members 103, 105 and 107 are dependent upon the thickness of the rib members (measured perpendicularly inward from the respective walls). The greater the thickness of the rib members, the greater will be the spacings between adjacent ones of the rib members, so that cylindrically-shaped articles, such as beverage containers, stored in tray 101 are able to contact the respective walls of tray 101 within the respective recessed regions 109, as described in greater detail with reference to FIGS. 25–28. First, second and third sets of rib members 103, 105 and 107 define respective first, second and third sets of grooves 111, 113 and 115 on the corresponding outer surfaces of tray 101.

Side walls 15 and 17 and end walls 19 and 21 are preferably angled outwardly with respect to a vertical axis which is perpendicular to bottom member 13, to provide a predetermined draft angle to facilitate loading of beverage containers into tray 101. Bottom member 13, side walls 15 and 17, end walls 19 and 21 and first, second and third rib members 103, 105 and 107 are preferably formed as an integral unit using a convention thermoforming process. Tray 101 is preferably comprised of a lightweight plastic material.

Figure 18:
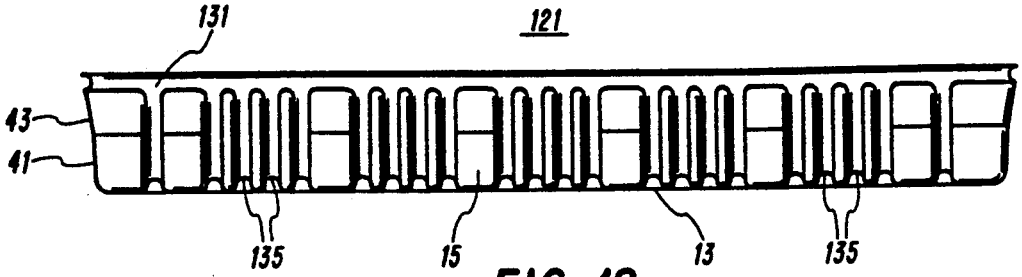
FIGS. 18–20 are side elevation, end elevation and top plan views, respectively, of a sixth embodiment of a tray, according to the present invention.
Figure 19:
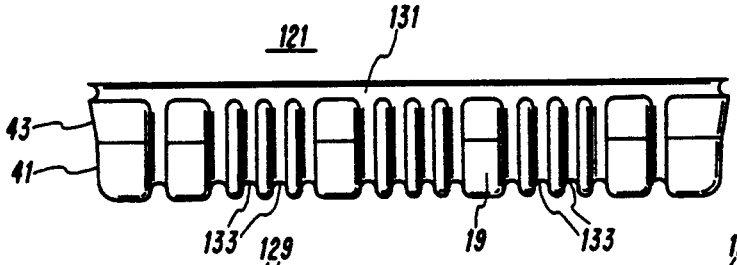
Figure 20:
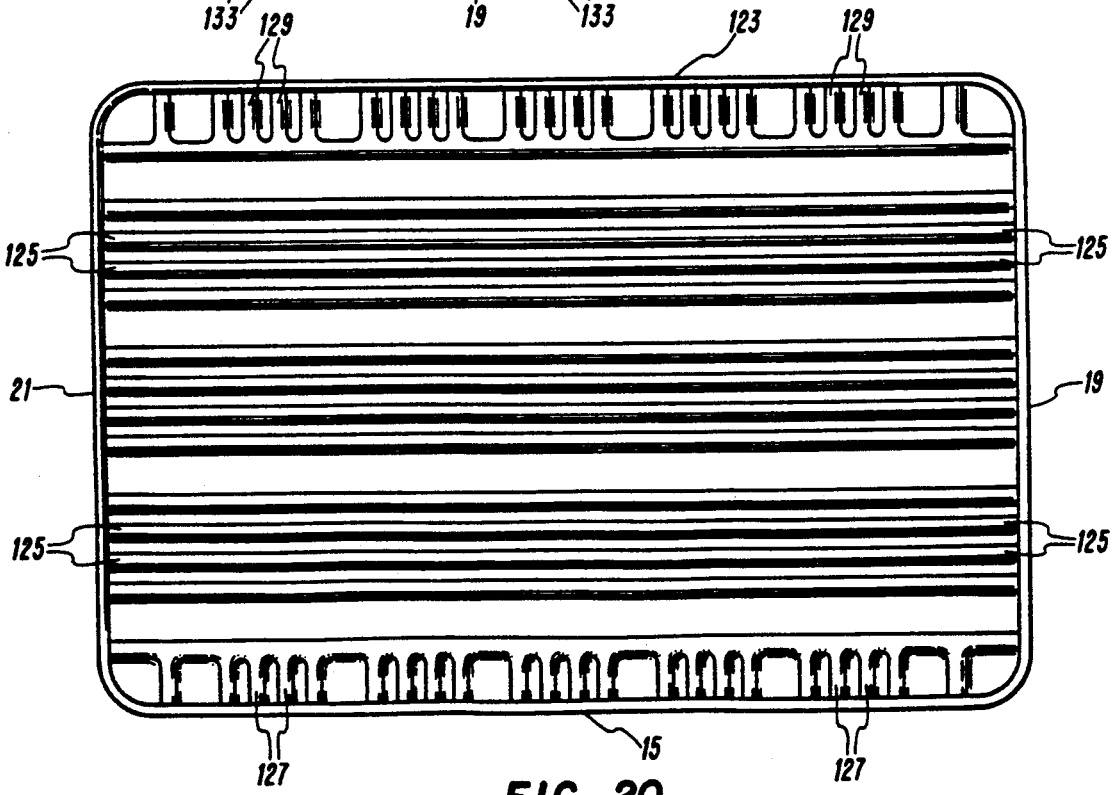

Referring to FIGS. 18–20, a sixth embodiment of a tray 121 according to the present invention is depicted. Tray 121 is substantially the same as tray 101, described above with reference to FIGS. 14–17, except that tray 121 includes a rim member 123 extending inwardly around the perimeter of tray 121 and has "compound" walls wherein respective lower portions 41 thereof are oriented substantially vertically and respective upper portions 43 thereof are angled outwardly with respect to a vertical axis to provide a predetermined draft angle.

Tray 121 further includes fourth, fifth and sixth sets of rib members 125, 127 and 129 disposed at substantially equal intervals between respective adjacent cooperating pairs of first, second and third sets of rib members 103, 105 and 107. Fourth set of rib members 125 extends vertically along substantially the entire height of first end wall 19, longitudinally along bottom member 13 and vertically along substantially the entire height of second end wall 21. Fifth and sixth sets of rib members 127 and 129 extend vertically along substantially the entire heights of respective first and second side walls 15 and 17 and partially inwardly across bottom member 13 and terminate at respective intersections on bottom member 13 with the respective ones of first set of rib members 103 which are closest to respective first and second side walls 15 and 17. Rim member 123 and fourth, fifth and sixth rib members 125, 127 and 129 define corresponding sets of grooves 131, 133 and 135 in the respective outer surfaces of tray 121.

Figure 21:
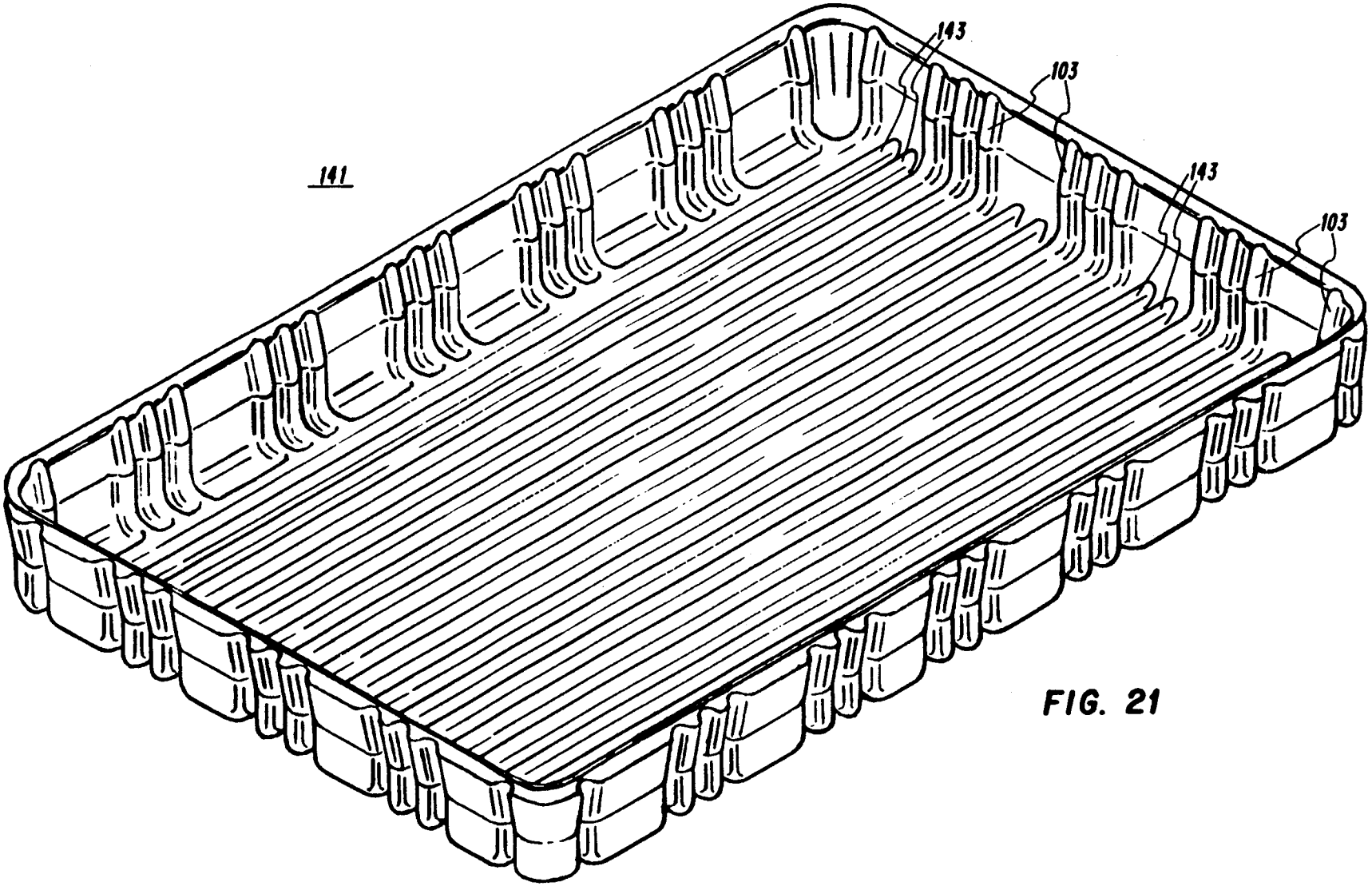
FIG. 21 is a perspective view of a seventh embodiment of a tray, according to the present invention.

Referring to FIG. 21, a seventh embodiment of a tray 141 according to the present invention is depicted. Tray 141 is substantially the same as tray 121, described above with reference to FIGS. 18–20, except that tray 141 further includes a seventh set of rib members 143 extending longitudinally along bottom member 13 between first and second end walls 19 and 21. Seventh set of rib members 143 are disposed between individual ones of each cooperating pair of first rib members 103, for dividing the corresponding recessed regions 109 between cooperating pairs of first rib members 103 into substantially equal sub-regions along bottom member 13. Seventh rib members 143 do not extend vertically along respective end walls 19 and 21, but rather terminate at the respective intersections with end walls 19 and 21. Seventh rib members 143 define a corresponding seventh set of grooves 145 in the respective outer surfaces of tray 141.

Figure 22:
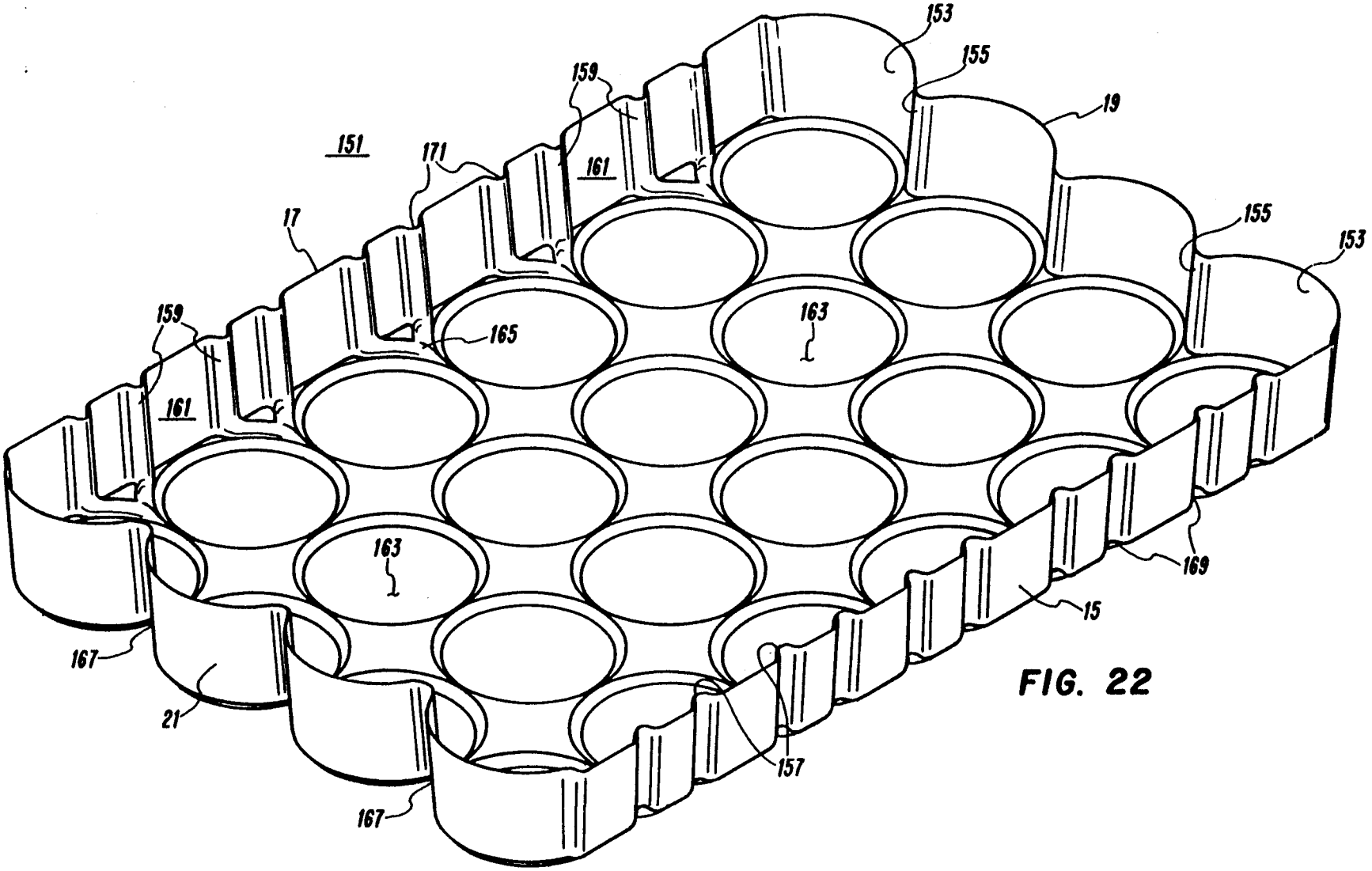
FIG. 22 is a perspective view of an eighth embodiment of a tray, according to the present invention.
Figure 28:
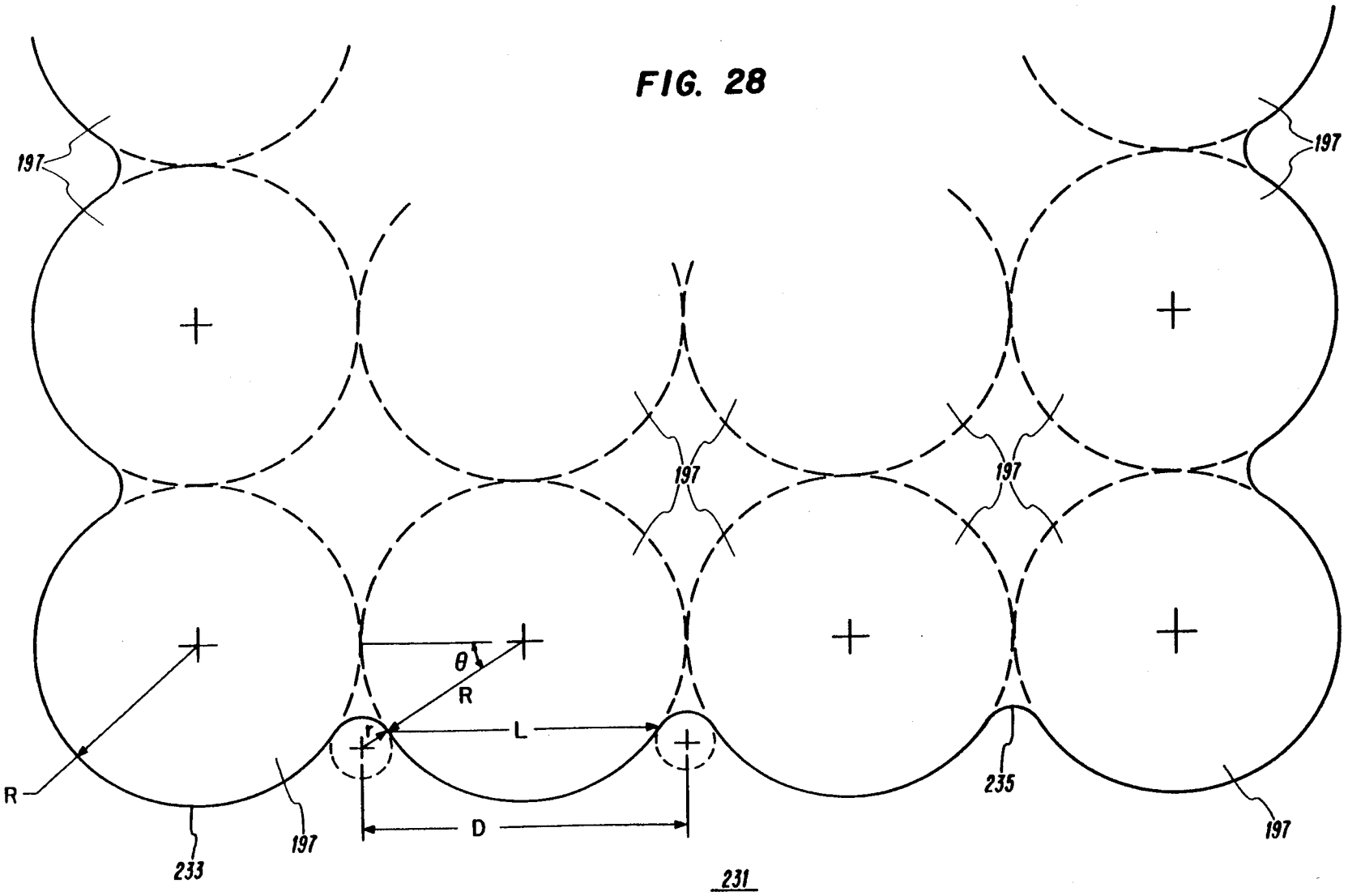

Referring to FIG. 22, an eighth embodiment of a tray 151 according to the present invention is depicted. First and second end walls 19 and 21 are comprised of a plurality of recessed regions 153 separated by corresponding ones of a plurality of inwardly extending surfaces 155 to provide a substantially scalloped appearance on end walls 19 and 21. The end wall surface within each recessed region 153 is curved to conform to the curved surface of the corresponding article which is to be stored and transported within tray 151, so that substantially the entire curved surface of the portion of the article which is disposed within the corresponding recessed region 153 is in contact with the end wall surface within each region 153, as best seen in FIG. 28.

First and second side walls 15 and 17 have respective first and second sets of rib members 157 and 159 extending vertically along substantially the entire height of the respective side walls 15 and 17 and partially inwardly across bottom member 13. Selected ones of first and second sets of rib members 157 and 159 are arranged in cooperating pairs to define respective recessed regions 161 therebetween.

Bottom member 13 includes a plurality of receptacles 163, which are preferably circularly shaped to conform to the cylindrical shape of the articles which are stored and transported within tray 151. The portion of bottom member 13 surrounding each receptacle 163 is beveled to substantially conform to the beveled shape of the chine portion of a typical beverage can which is loaded into tray 151. Individual rib members 157 and 159 in each cooperating pair diverge away from one another along bottom member 13 so that at least a portion of a corresponding receptacle 163 is received within the corresponding recessed region 161 defined by each cooperating pair of rib members. Similarly, the individual rib members 157 and 159 in each cooperating pair converge toward the respective adjacent rib members 157 and 159 on opposite sides of the corresponding recessed region 161, so that the individual rib members in each cooperating pair intersect with respective adjacent rib members between respective adjacent receptacles 163, as indicated at 165. Side walls 15 and 17 and end walls 19 and 21 are oriented substantially vertically with respect to bottom member 13 so that walls 15, 17, 19 and 21 have a negligible draft angle. Inwardly extending surfaces 155 and first and second sets of rib members 157 and 159 form respective grooves 167, 169 and 171 in the corresponding outer surfaces of tray 151.

Figure 23:
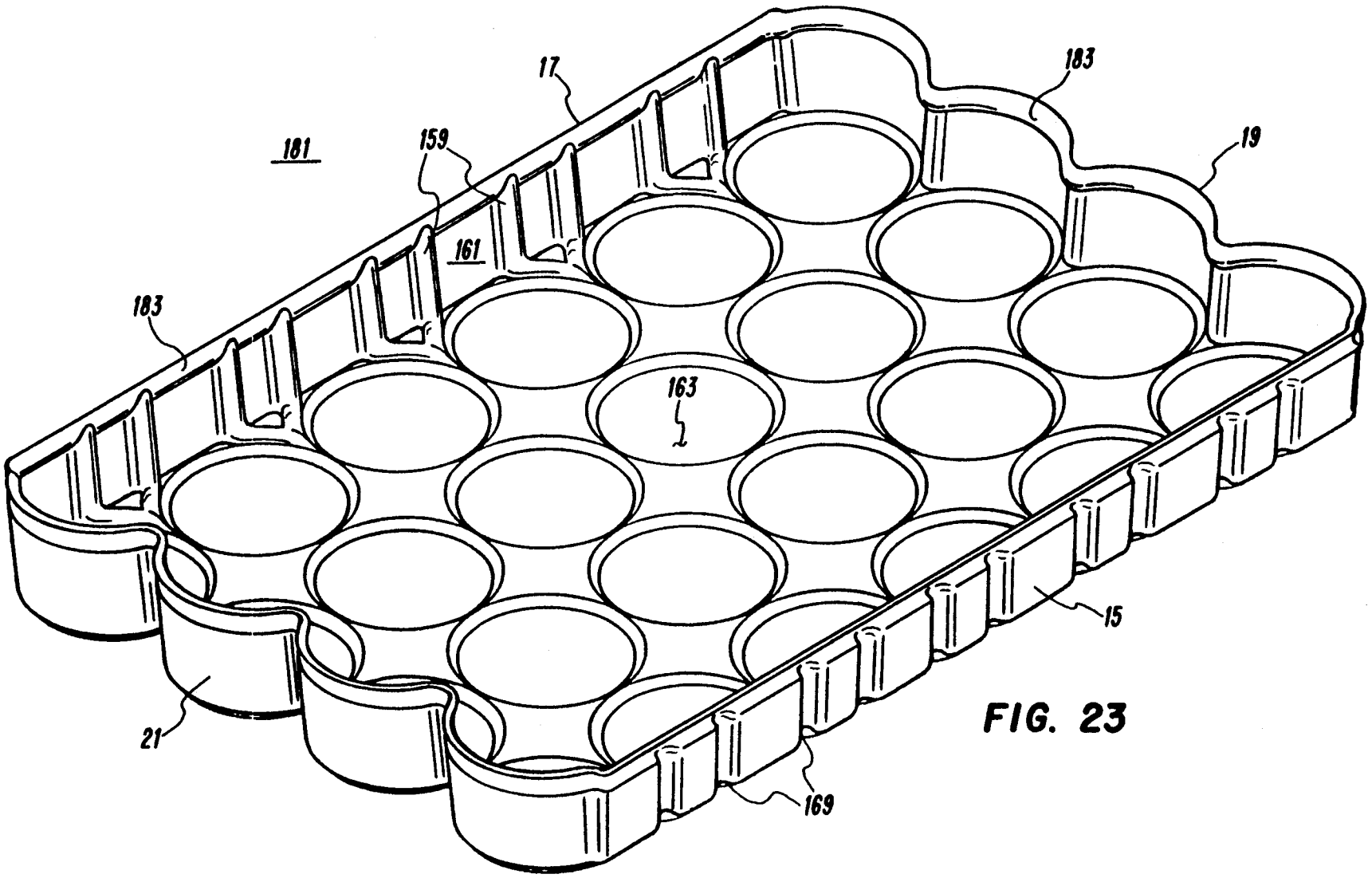
FIG. 23 is a perspective view of a ninth embodiment of a tray, according to the present invention.

Referring to FIG. 23, a ninth embodiment of a tray 181 is depicted. Tray 181 is substantially the same as tray 151, described above with reference to FIG. 22, except that tray 181 includes a rim member 183 extending inwardly adjacent to the upper edge of tray 181 around the perimeter thereof. Rim member 183 forms a corresponding groove in the respective outer surfaces of tray 181.

Figure 24:
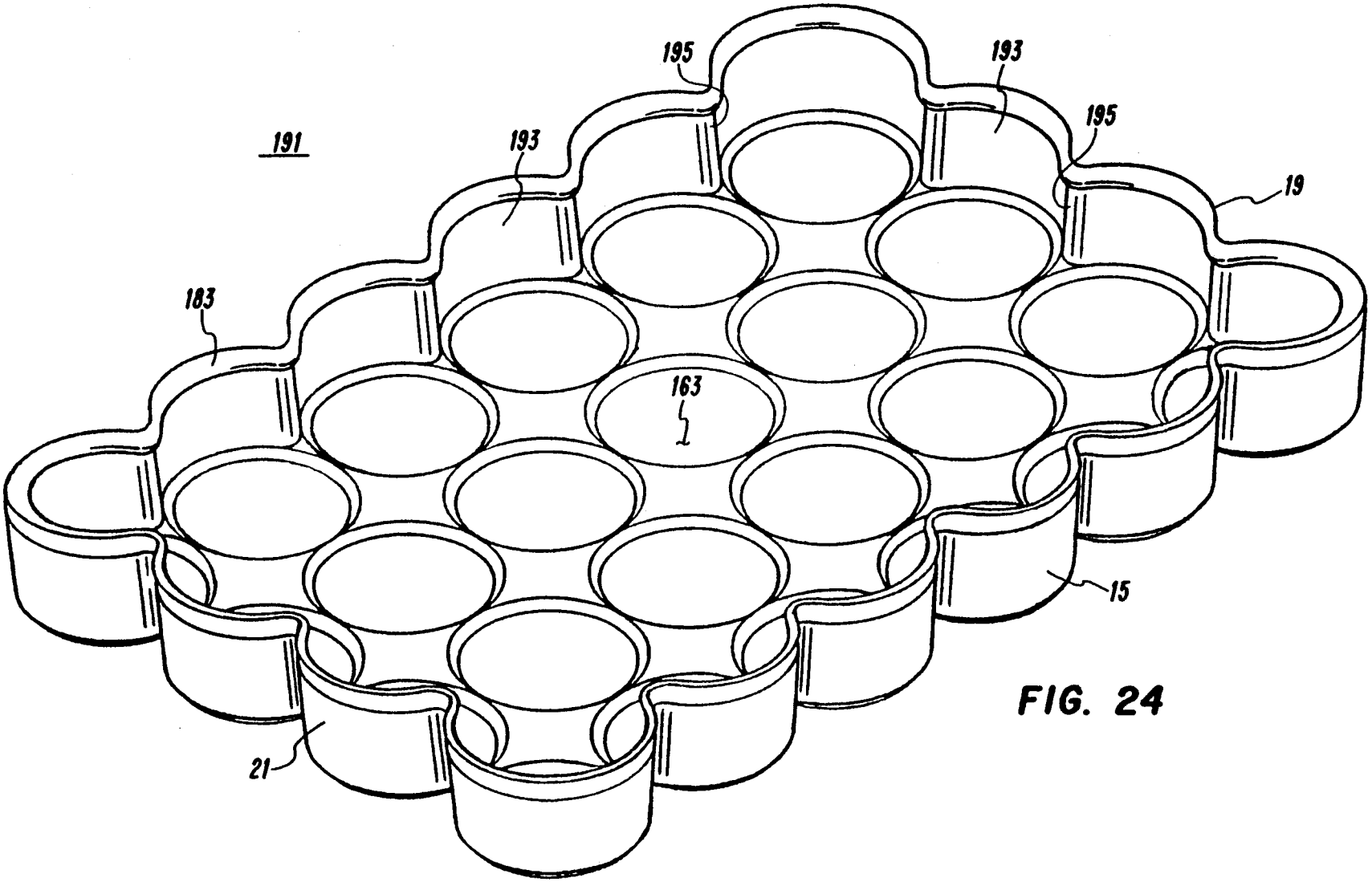
FIG. 24 is a perspective view of a tenth embodiment of a tray, according to the present invention.

Referring to FIG. 24, a tenth embodiment of a tray 191 according to the present invention is depicted. Each of the four walls 15, 17, 19 and 21 of tray 191 is comprised of a plurality of recessed regions 193 separated by corresponding ones of a plurality of inwardly extending surfaces 195, to provide a substantially scalloped appearance on all four walls of tray 191. Otherwise, tray 191 is substantially the same as tray 181, described above with reference to FIG. 23.

Figure 25:
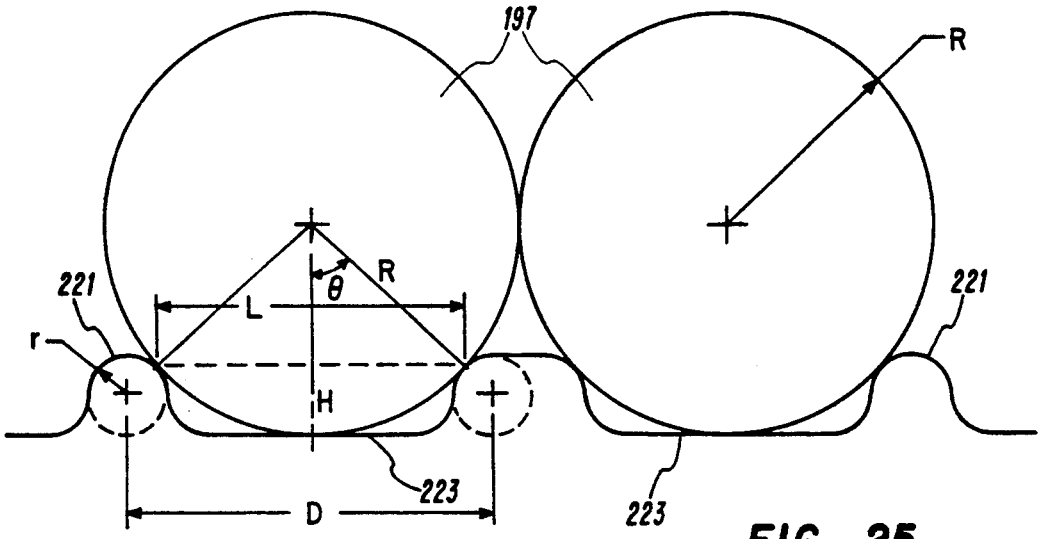
FIGS. 25–28 are top plan views illustrating the engagement between articles loaded into a tray and the walls of a tray, according to the present invention.
Figure 26:
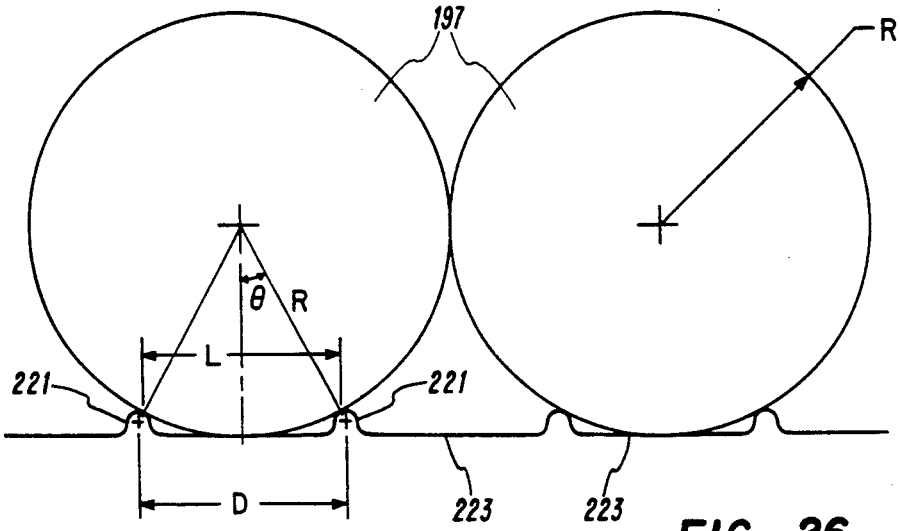
Figure 27:
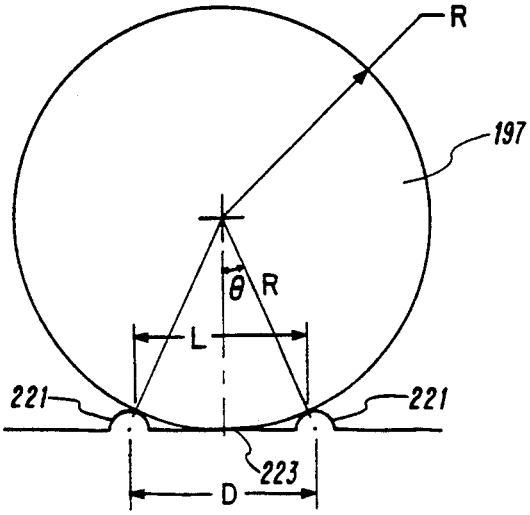

Referring to FIGS. 25–27, the respective points of contact between each article 197 and the corresponding rib members 221 and wall 223 of a tray according to the present invention are depicted. In FIGS. 25 and 26, the curvature of each rib member 221 is such that an imaginary circle is transcribed by a cross-section of each rib member 221, taken horizontally along an axis perpendicular to the corresponding wall 223. The imaginary circle is tangent to the plane of the particular wall 223 from which rib member 221 extends, as represented by the dotted curve. FIG. 25 and 26 illustrate the dependency of the spacing between individual rib members 221 as a function of the "thickness" of rib members 221. Because of the curvilinear nature of rib members 221, it is convenient to represent the "thickness" thereof in terms of the radius of curvature r of rib members 221, as measured from the center of the imaginary circle. The radius of each cylindrical container 197 is represented by R. The lateral distance D between the respective centers of adjacent rib members 221 is represented geometrically as follows:

$$D = 4\sqrt{rR}$$

The distance H between wall 223 and the point of tangency between container 197 and each rib member 221, as measured along an axis perpendicular with respect to wall 223, is represented by the following geometrical relationship:

$$H=2rR/(r+R)$$

The lateral distance L between points of tangency of each container 197 with adjacent rib members 221 of the corresponding cooperating pair of rib members, as measured parallel to the corresponding wall 223, is represented by the following geometrical relationship:

$$L=2R\sin\theta=Rd/2(R+r)$$

One skilled in the art will recognize that the spacing D between adjacent rib members 221 of each cooperating pair is proportional to the square root of the radius of curvature r of rib members 221. For example, in FIG. 26 the radius of curvature r of rib members 221 is substantially less than the corresponding radius of curvature r of rib members 221 in FIG. 25. Therefore, the distance D between the respective centers of adjacent rib members 221 is substantially less in FIG. 26 than in FIG. 25.

Referring to FIG. 27, rib members 221 have a semicircular shape. The geometric relationships D, H and L are expressed as follows as a function of the radius of curvature r of rib members 221 and the radius R of articles 197.

$$D = 2\sqrt{r(2R + r)}$$

$$H=Rr/(R+r)$$

$$L=2R\sin\theta=RD/2(R+r)$$

Referring to FIG. 28, a tray 231 in which all four walls 233 are scalloped, as in FIG. 24, is depicted. In this case r represents the radius of curvature (as measured from the center of the imaginary circle represented by the dotted curve) of each inwardly extending portion 235 along each of the four walls 233. The spacing D between respective centers of adjacent ones of extension portions 235 along each wall 233 and the lateral distance L between the respective points of tangency of each container 197 with the respective extension portions 235 are represented by the following geometric relationship:

$$D=2R$$

$$L=2R\cos\theta=R^2/(r+R)$$

One skilled in the art will appreciate that when articles 197 are stored in tray 231, the spacing D between the respective centers of adjacent ones of extension portions 235 is solely dependent upon the radius R of each article 197. The lateral distance L between the respective points of tangency of each container 197 and the respective extension portions 235 decreases as the radius of curvature r increases.

Figure 29:
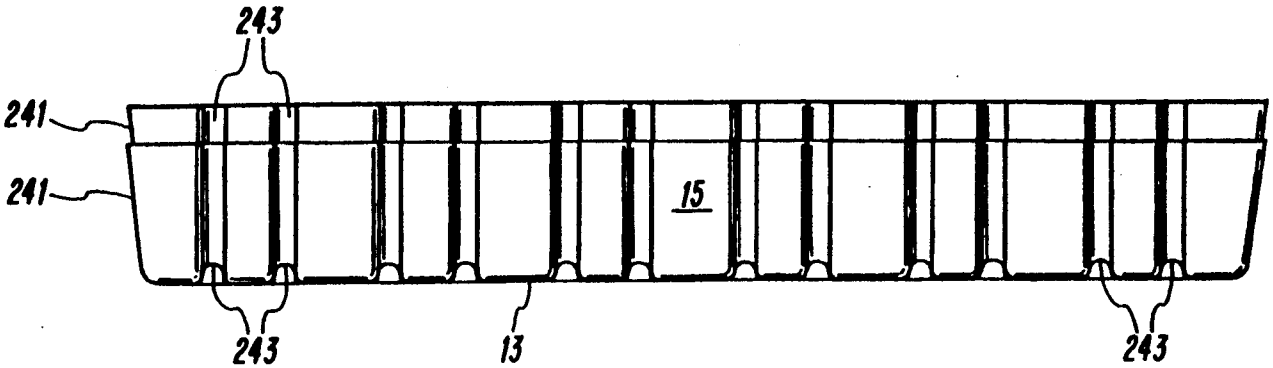
FIGS. 29 and 30 are side elevation and end elevation views, respectively, of two trays being nested together while empty, according to the present invention.
Figure 30:
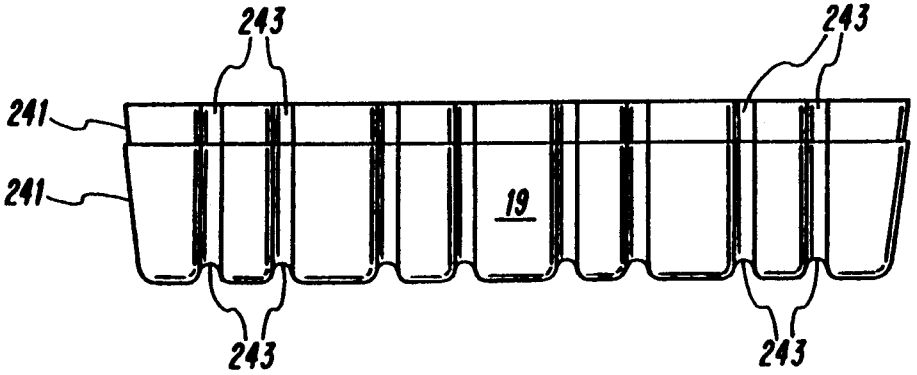
Figures 31, 32:
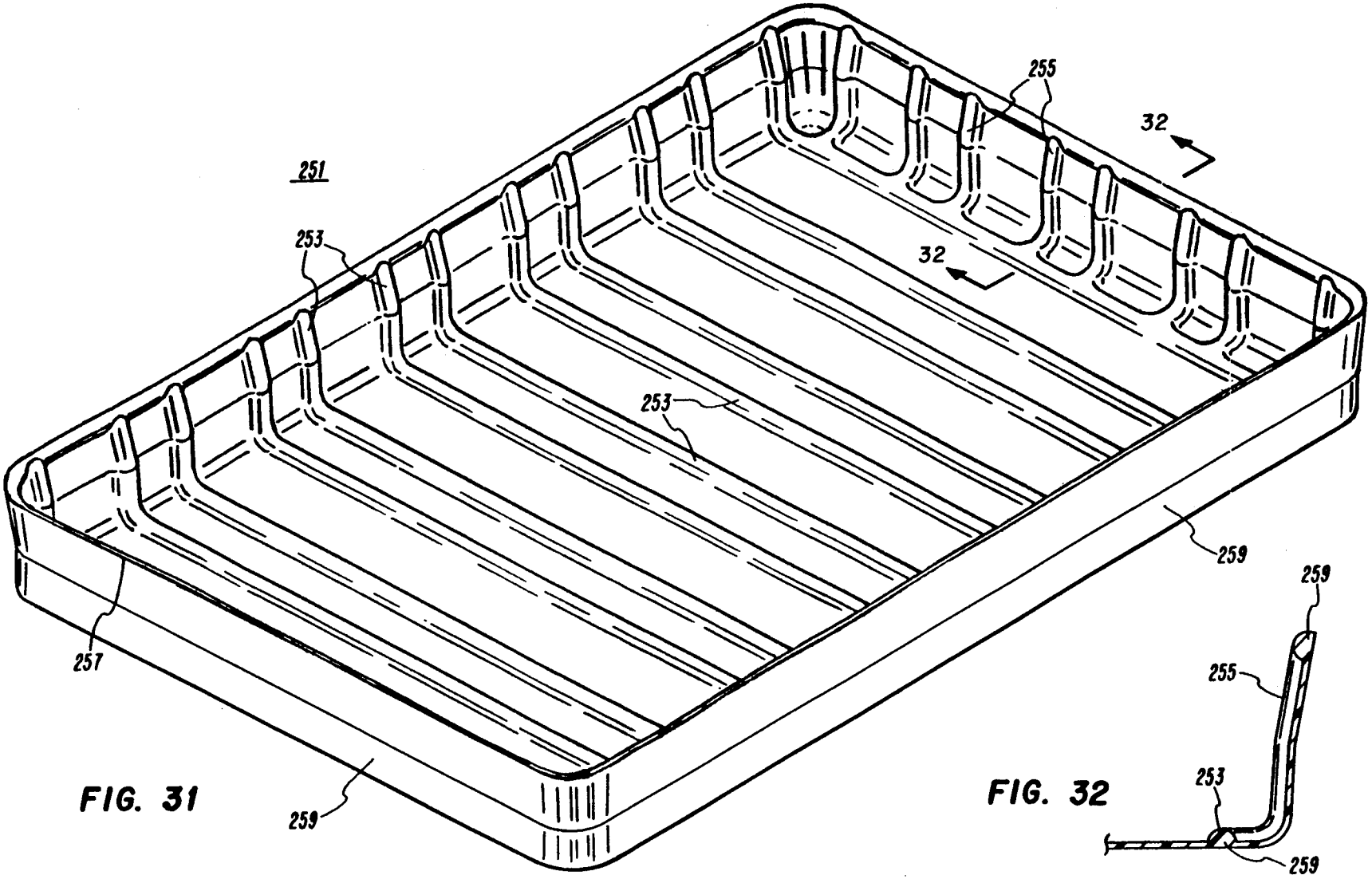
FIG. 31 is a perspective of an eleventh embodiment of a tray according to the present invention.
FIG. 32 is a sectional view of a portion of the tray of FIG. 31, taken along the section line indicated in FIG. 31.
Figure 33:
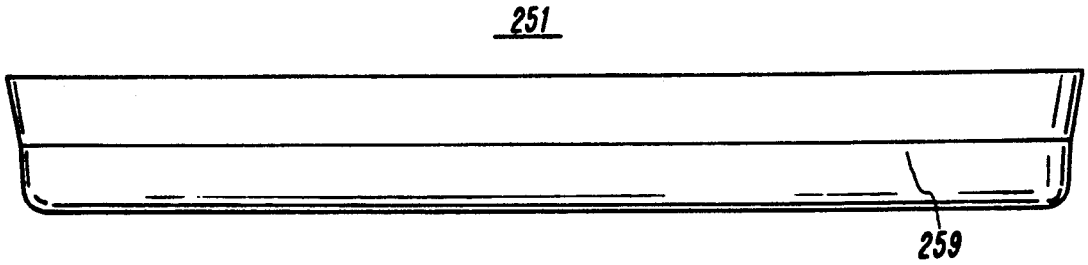
FIG. 33 is a side elevation view of the tray of FIG. 31.
Figure 34:
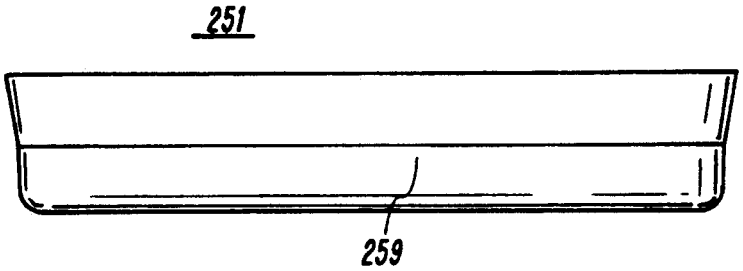
FIG. 34 is an end elevation view of the tray of FIG. 31.
Figure 35:
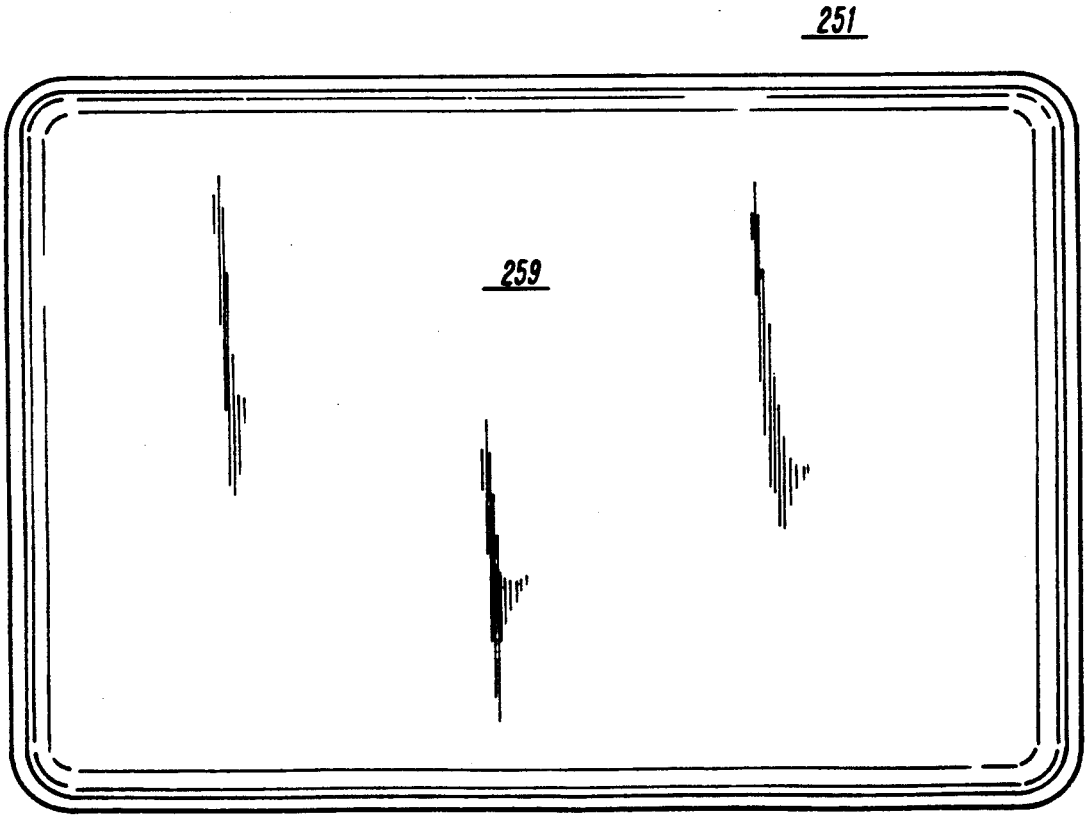
FIG. 35 is a bottom plan view of the tray of FIG. 31.

Another aspect of the invention is illustrated in FIGS. 29 and 30. Two trays 241 are nested together by inserting the bottom portion of a first one of trays 241 into the enclosure formed by the bottom member and four walls of a second tray 241. The draft angle of the walls of each tray 241 facilitates the nesting of trays 241. One skilled in the art will appreciate that grooves 243 defined by the corresponding rib members (not shown) on the outer surfaces of first tray 241 will mate with the complementary rib members on the inner surfaces of second tray 241 along the respective four walls of the two trays 241, to conserve storage space when the trays are not in use.

Referring to FIGS. 31–35, an eleventh embodiment of a tray 251 according to the present invention is depicted. Tray 251 is substantially the same as tray 11, described above with reference to FIGS. 1–4, except that first, second and third sets of rib members 253, 255 and 257 do not define corresponding grooves on the respective outer surfaces of tray 251. Rather, the respective outer surfaces of tray 251 are substantially smooth to enhance the structural integrity of the tray. When multiple trays filled with canned beverages are stacked one on top of the other, the rib members of the trays in the vicinity of the bottom of the stack, particularly the portions of the rib members formed on the respective bottom members of the trays, are subjected to large compressive forces. By forming the rib members on the inner surfaces of the tray to eliminate the corresponding grooves on the respective outer surfaces 259 so that respective outer surfaces 259 are substantially smooth, the structural strength of the rib members is substantially enhanced. One skilled in the art will appreciate that it is advantageous to eliminate the grooves on the outer surfaces opposite the respective rib members in all of the trays described above with references to FIGS. 1-23, so that the respective outer surfaces are substantially smooth.

Figure 36:
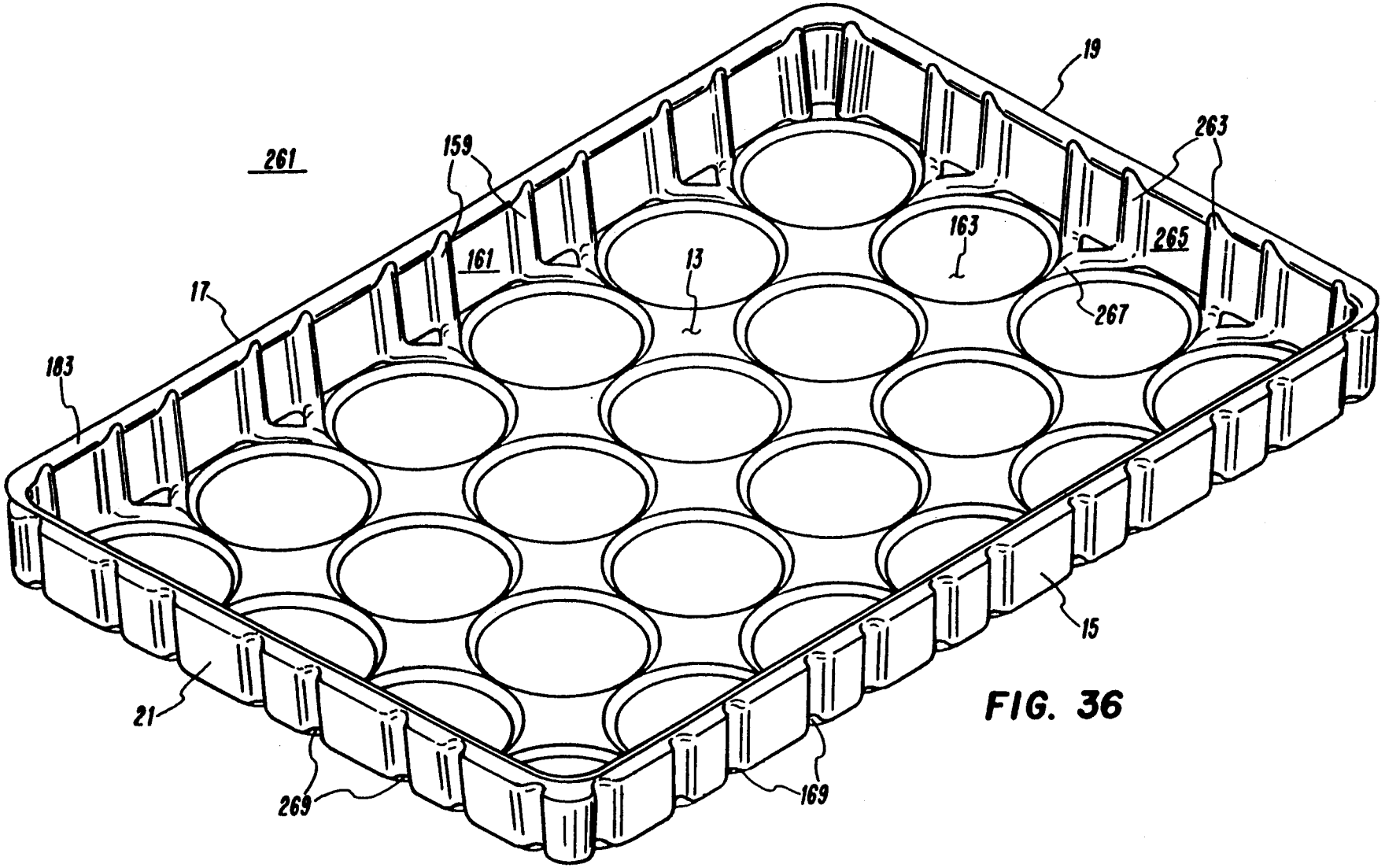
FIG. 36 is a perspective view of a twelfth embodiment of a tray, according to the present invention.

Referring to FIG. 36, a twelfth embodiment of a tray 261 according to the present invention is depicted. Tray 261 is substantially the same as tray 181, described above with reference to FIG. 23, except that the scalloped surfaces comprising end walls 19 and 21 of tray 181 are replaced with relatively flat wall surfaces having respective third and fourth sets of rib members 263 disposed on respective inner surfaces thereof. Only the third set of rib members 263 is shown in FIG. 36.

Third and fourth sets of rib members 263 extend vertically along substantially the entire height of the respective end walls 19 and 21 and partially inwardly along bottom member 13. Selected ones of third and fourth sets of rib members 263 are arranged in cooperating pairs to define respective recessed regions 265 therebetween. Individual rib members 263 in each cooperating pair diverge away from one another along bottom member 13 so that at least a portion of the corresponding receptacle 163 is received within the corresponding recessed region 265 defined by each cooperating pair of rib members 263. Similarly, individual rib members 263 in each cooperating pair converge toward the respective adjacent rib members 263 on opposite sides of the corresponding recessed region 265, so that individual rib members in each cooperating pair intersect with respective adjacent rib members between respective adjacent receptacles 163, as indicated at 267. Third and fourth sets of rib members 263 define respective grooves 269 on the respective outer surfaces of end walls 19 and 21 of tray 261. Only grooves 269 associated with fourth set of rib members 263 are shown in FIG. 36.

Referring to FIGS. 37-40, a thirteenth embodiment of a tray 271 according to the present invention is depicted. Tray 271 is comprised of a bottom member 273, a pair of oppositely positioned side walls 275 and 277 and a pair of oppositely positioned end walls 279 and 281, interconnected to form an enclosure for receiving articles therein.

Disposed on respective inner surfaces of side walls 275 and 277 and end walls 279 and 281 are a plurality of substantially vertical rib members 283, which are arranged in cooperating pairs to define respective recessed regions 285 therebetween. The spacings between adjacent ones of vertical rib members 283 are dependent upon the thickness of rib members 283 (measured perpendicularly outward from the respective walls) and the diameter of the container, as previously described. The greater the thickness of rib members 283, the greater will be the spacings between adjacent ones of rib members 283, so that cylindrically-shaped articles, such as beverage containers, stored in tray 271 are able to contact the respective walls within respective recessed regions 285.

Vertical rib members 283 extend substantially along the entire height of corresponding walls and terminate at respective intersections with a perimeter rim member 287, which is disposed adjacent to the upper edge of tray 271. Rim member 287 extends outwardly and curves downwardly from the upper edge of tray 271.

Figure 40:
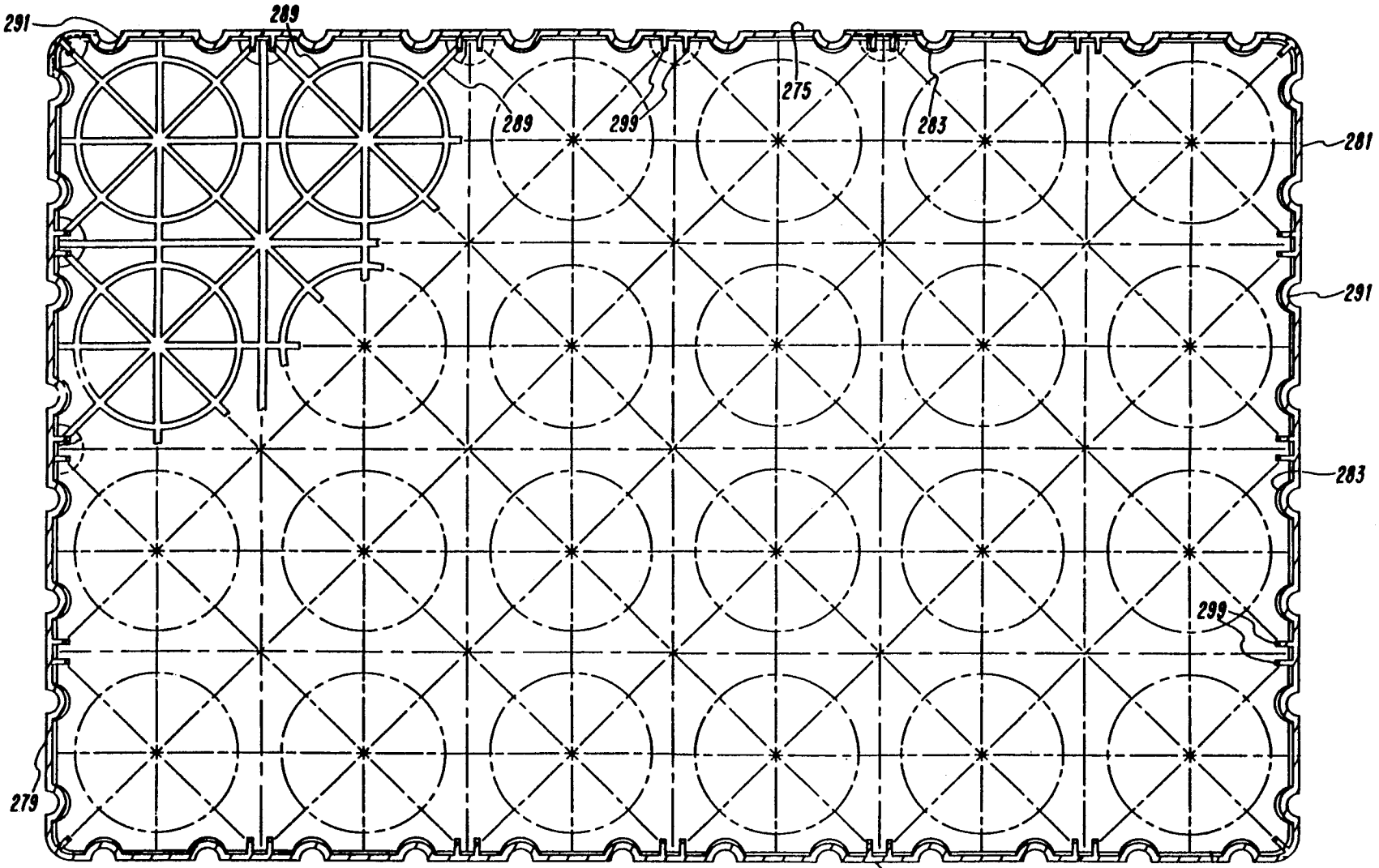

Tray 271 is preferably formed as an integral unit using a conventional injection molding process. Tray 271 is preferably comprised of a lightweight plastic material. Bottom member 273 is comprised of a plurality of horizontal rib members 289 having a substantially rectangular shape, which define a predetermined grid pattern as best shown in FIG. 40. Rib members 289 are T'ed into the corresponding walls of tray 271. Portions of rib members 289 define a substantially circular shape for supporting the cylindrically shaped articles packed into tray 271. In one embodiment horizontal rib members 289 are formed on a relatively thin bottom surface, while in an alternate embodiment, the bottom of tray 271 is open between rib members 289 to conserve material and reduce the cost of manufacturing the tray.

Each vertical rib member 283 defines a corresponding vertical groove 291 in the corresponding outer surface of tray 271. Vertical rib members 283 have a substantially half-conical shape, such that a horizontal section line taken through any rib member 283 defines a substantially semi-circular shape. The width of each rib member 283 (a measured horizontally along the corresponding wall) is greatest adjacent to bottom member 273 and decreases upwardly along the corresponding wall so that the width of each rib member 283 is smallest adjacent to its intersection with rim member 287. The shape of the corresponding groove 291 defined by each rib member 283 is substantially a mirror image of the corresponding rib member 283. The half-conical shape of rib members 283 allows multiple trays 271 to be nested to a predetermined depth within the bottom tray 271. Otherwise, the thickness of the tray walls will prevent nesting to the predetermined depth.

Figure 38:
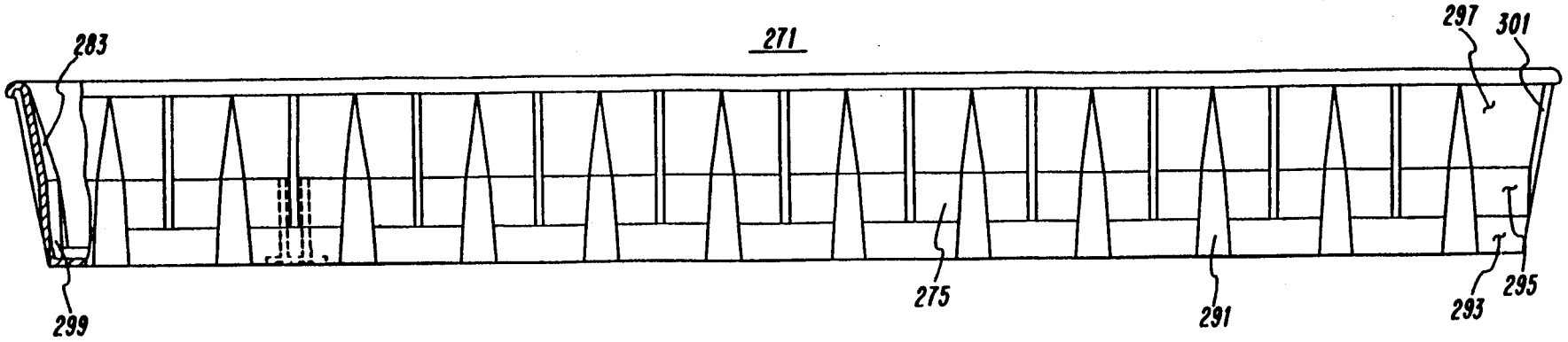
Figure 39:
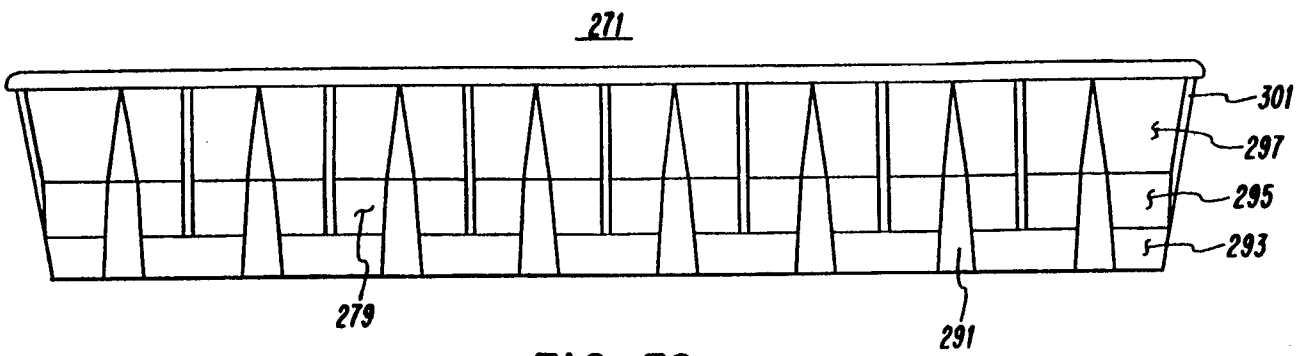

Side walls 275 and 277 and end walls 279 and 281 are preferably "compound" walls, as best seen in FIGS. 38 and 39, to allow multiple trays 271 to be nested together when empty, thereby saving storage space. Each wall is comprised of three portions, a lower portion 293, an intermediate portion 295 and an upper portion 297. Lower portion 293 and upper portion 297 have approximately the same draft angle and intermediate portion 295 has a draft angle which is substantially less than the draft angle of lower portion 293 and upper portion 297.

Figure 37:
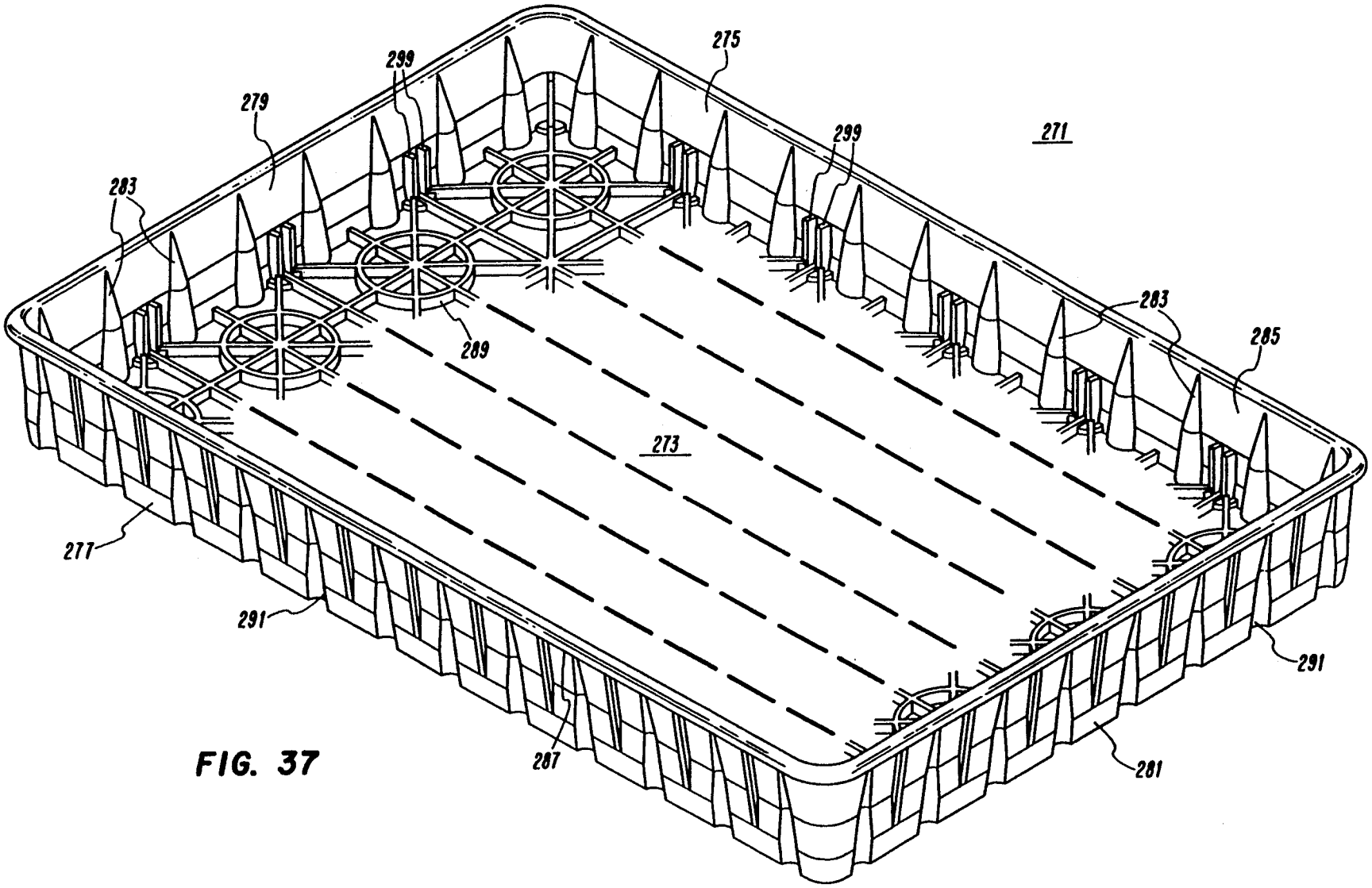
FIGS. 37–40 are respective perspective, side elevation, end elevation and top plan views of a thirteenth embodiment of a tray, according to the present invention.
Figure 41:
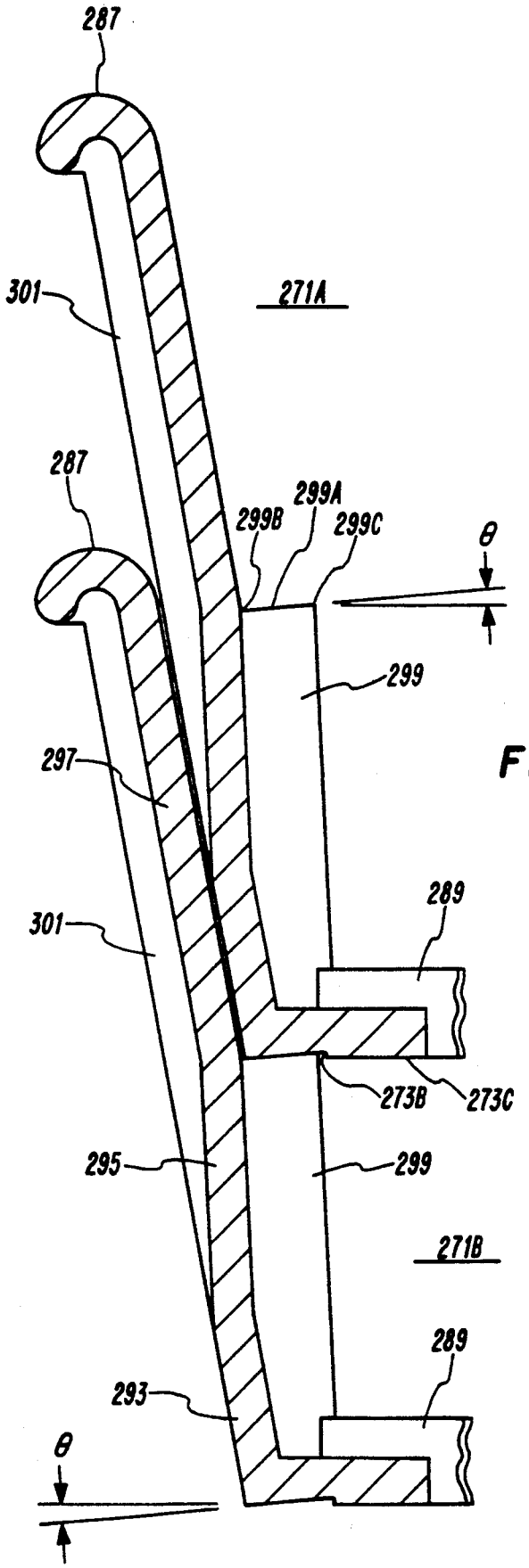
FIG. 41 is a sectional view showing the nesting of a pair of trays of the type depicted in FIGS. 37–40.

Tray 271 further includes a plurality of posts 299 arranged in cooperating pairs along the inner surfaces of side walls 275 and 277 and end walls 279 and 281, as can be best seen in FIG. 37. Each cooperating pair of posts is disposed between each cooperating pair of rib members 283 on the inner surfaces of the tray walls. A single post 299 is positioned at each intersection between walls. Posts 299 have a substantially rectangular shape and a top surface 299A of each post 299 is inclined upwardly in a direction from an intersection 299B of the corresponding post 299 with the corresponding wall to an inner surface 299C of the corresponding post 299, at an angle $\theta$ (e.g., approximately 5°), as can be best seen in FIG. 41. Posts 299 are used to support bottom member 273 of another tray 271 when two or more trays 271A and 271B are nested together, as best seen in FIG. 41. Posts 299 extend from bottom member 273 upwardly to a horizontal line passing through the intersection of intermediate portion 295 and upper portion 297 on each of the tray walls (hereinafter referred to as the "nesting plane") to prevent tray 271A from being inserted within the enclosure formed by tray 271B below the nesting plane of tray 271B.

A portion 273A of bottom member 273 of each tray 271, adjacent each of the tray walls, is also inclined upwardly in a direction from an intersection 274 of the corresponding bottom member 273 with the corresponding wall to a position which is slightly inward of inner surface 299C, at an angle $\theta$ (e.g., approximately 5°), as can be best seen in FIG. 41. The portion 273B of bottom member 273 inward of inclined portion 273A is relatively flat to define a shoulder 273C between inclined portion 273A and flat portion 273B. The engagement between the two inclined surfaces 299A of the respective posts 299 and inclined portion 273A of bottom member 273 is such that when multiple trays 271 are nested, the weight acting on the support posts 299 of each tray includes a component directed along an axis substantially parallel to the plane of each top surfaces 299A and a component directed substantially perpendicular to the plane of each top surface 299A. The number of trays in the nest and the position of a particular tray in the nest will determine the amount of weight acting on the particular tray. The lowermost trays in the nest are of course subjected to the greatest weight. The engagement between the complementary inclined surfaces 299A and 273A allows the weight above each tray in the "nest" to be distributed more efficiently and causes the walls of each tray to be drawn inwardly into contact with external rib members 301 of the tray immediately above, to prevent the trays in the nest from collapsing outwardly due to the weight of the nested trays.

As best seen in FIG. 37, external rib members 301 are disposed on respective outer surfaces of the tray walls to enhance the structural strength and integrity of tray 271. Rib members 301 have a substantially rectangular shape and extend vertically along the corresponding outer surfaces of tray 271 from rim member 287 to a horizontal line passing through the intersection of lower portion 293 with intermediate portion 295 on the corresponding walls.

As can be best seen in FIG. 41, respective inner surfaces of the upper portions 297 of the walls of each tray are drawn into contact with the respective external rib members 301 on the walls of the tray immediately above the nested configuration. Rib members 301 help align the respective rim members 287 of the nested trays along respective vertical axes. Furthermore, rib members 301 provide sufficient spacing between adjacent ones of the trays in the nest to prevent the trays from "locking" or sticking together.

As best seen in FIG. 38, the half-conical shape defined by rib members 283 and corresponding groove 291 is different above and below the nesting plane. The shape defined by rib members 283 and corresponding grooves 291 below the nesting plane on lower portion 293 and central portion 295 defines a truncated half-conical shape, while the portion of each rib member 283 and corresponding groove 291 above the nesting plane on upper portion 297 defines a substantially half-conical shape.

Referring to FIGS. 42–47B, a fourteenth embodiment of a tray 303 according to the present invention is depicted. Tray 303 is comprised of a bottom member 305, a pair of oppositely positioned side walls 307 and 309 and a pair of oppositely positioned end walls 311 and 313, interconnected to form an enclosure for receiving articles therein. Tray 303 further includes a peripheral rim member 315, which extends outwardly from respective top portions of walls 307, 309, 311 and 313.

Tray 303 is preferably formed as an integral unit using a conventional injection molding process. Tray 303 is preferably comprised of a lightweight plastic material. Bottom member 305 is comprised of a plurality of horizontal rib members 317 arranged in a predetermined grid pattern, as can be best seen in FIG. 42. Bottom member 305 further includes a plurality of substantially circular support rings 319, for engaging respective bottom portions of cylindrically-shaped articles, such as beverage containers, stored in the tray 303. Each ring 319 is adapted to support a single article in a substantially upright position. In one embodiment, horizontal rib members 317 and support rings 319 are formed on a relatively thin bottom surface, while in an alternate embodiment, the bottom of tray 303 is open between rib members 317 and inside support rings 319.

Each of the walls 307, 309, 311 and 313 has a plurality of support members 321 protruding from respective inner surfaces of the walls into the tray enclosure. Support members 321 have a substantially half-conical shape and are truncated to define respective relatively flat, upwardly facing support surfaces 323. Each support member 321 extends upwardly from bottom member 305 to a predetermined location on the corresponding tray wall. The width of each support member 321 (as measured horizontally along the corresponding wall) is greatest adjacent to bottom member 305 and decreases upwardly along the corresponding wall, such that the width of each support member 321 is smallest adjacent its support surface 323.

Each support member 321 defines a corresponding recess 325A or 325B in the outer surface of the corresponding tray wall. Each recess 325A, 325B has the shape of a truncated half-cone, which is complementary with the truncated half-conical shape of the corresponding support member 321 on the inside of tray 303.

A vertical rib 327 extends substantially from rim member 315 to each support surface 323. As can be best seen in FIG. 44, each rib 327 is beveled, such that each rib 327 protrudes the greatest distance inwardly adjacent support surface 323 and the smallest distance inwardly adjacent rim member 315.

Figure 43:
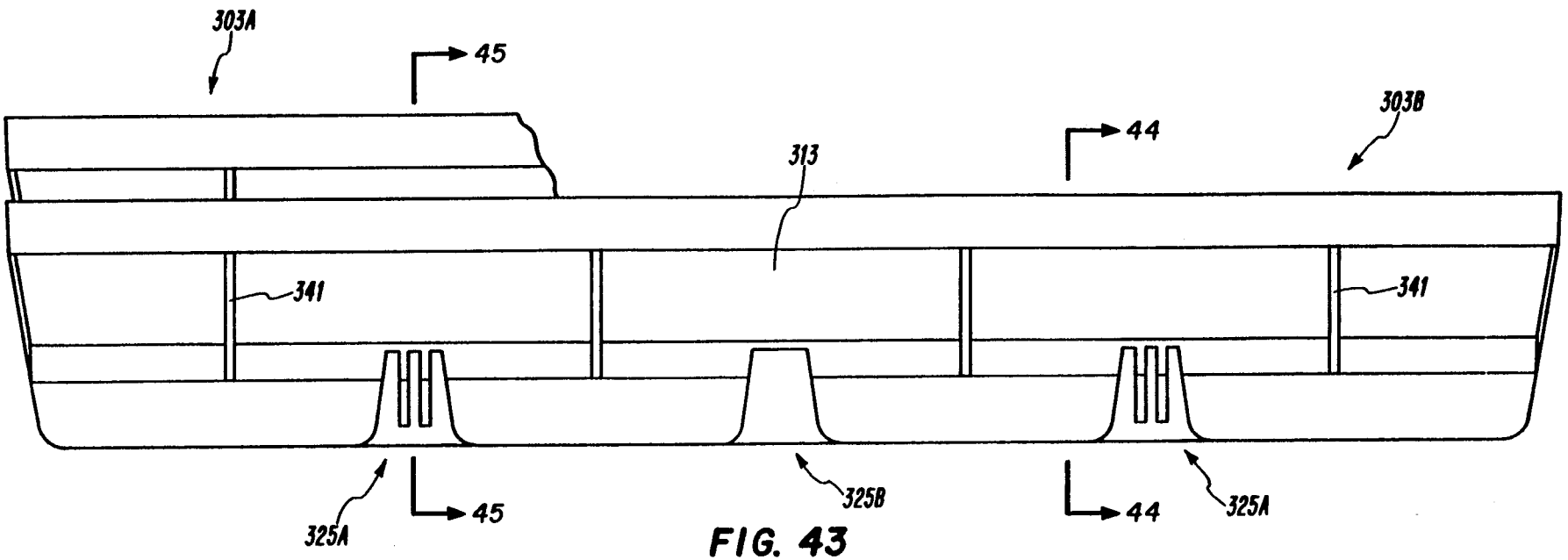
FIG. 43 is an end elevation view of the tray of FIG. 42, and a partial end elevation view of another tray, showing the two trays nested.
Figure 46:
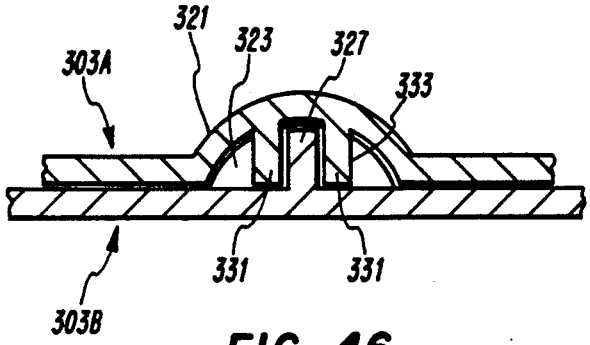
FIG. 46 is a vertical sectional view of the nested trays of FIG. 43, taken along the lines 46—46 in FIG. 45.
Figure 45:
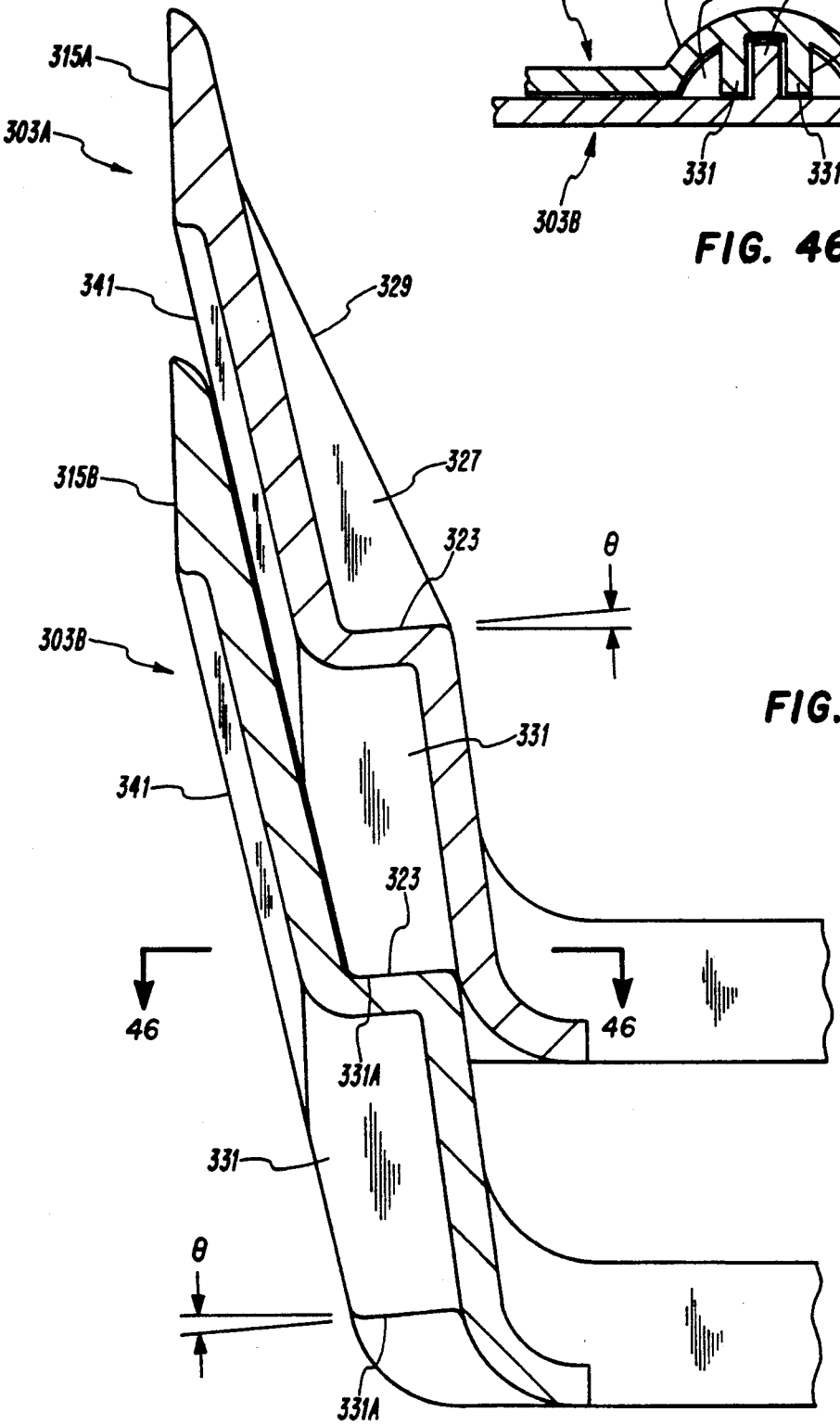
FIG. 45 is a sectional view of the nested trays of FIG. 43, taken along the line 45—45 in FIG. 43.

Recesses 325A each include a pair of dividers 331 for partitioning the corresponding recess into three portions. The central portion, which is disposed between dividers 331, defines an elongated slot 333 which is substantially complementary with vertical rib 327, so that when two trays are "nested", the slots 331 of the inside tray 303A matingly engage respective ones of the rib members 327 of the outside tray 303B, as can be best seen in FIGS. 45 and 46. When trays 303A and 303B are nested, as shown in FIGS. 43, 45 and 46, respective bottom surfaces 331A of the dividers 331 of each recess 325A of tray 303A are in facing contact with a corresponding support surface 323 of tray 303B, as can be best seen in FIG. 45. Each support surface 323 is inclined upwardly, at a relatively shallow angle $\theta$ (e.g., approximately 5°), in a direction from the corresponding wall inwardly. Similarly, bottom surface 331A of each divider 331 is inclined upwardly, at approximately the same angle $\theta$, in a direction from the corresponding wall inwardly, such that the weight of tray 303A includes a component directed along an axis substantially parallel to the plane of each support surface 323, as well as a component directed substantially perpendicular to the plane of each support surface 323. The engagement between the complementary inclined surfaces 323 and 331A allows the weight on each tray in the "nest" to be distributed efficiently and causes the walls of each tray to be drawn inwardly into contact with the external rib members 341 of the tray immediately above, to prevent the trays from collapsing outwardly due t the weight of the nested trays.

Figure 42:
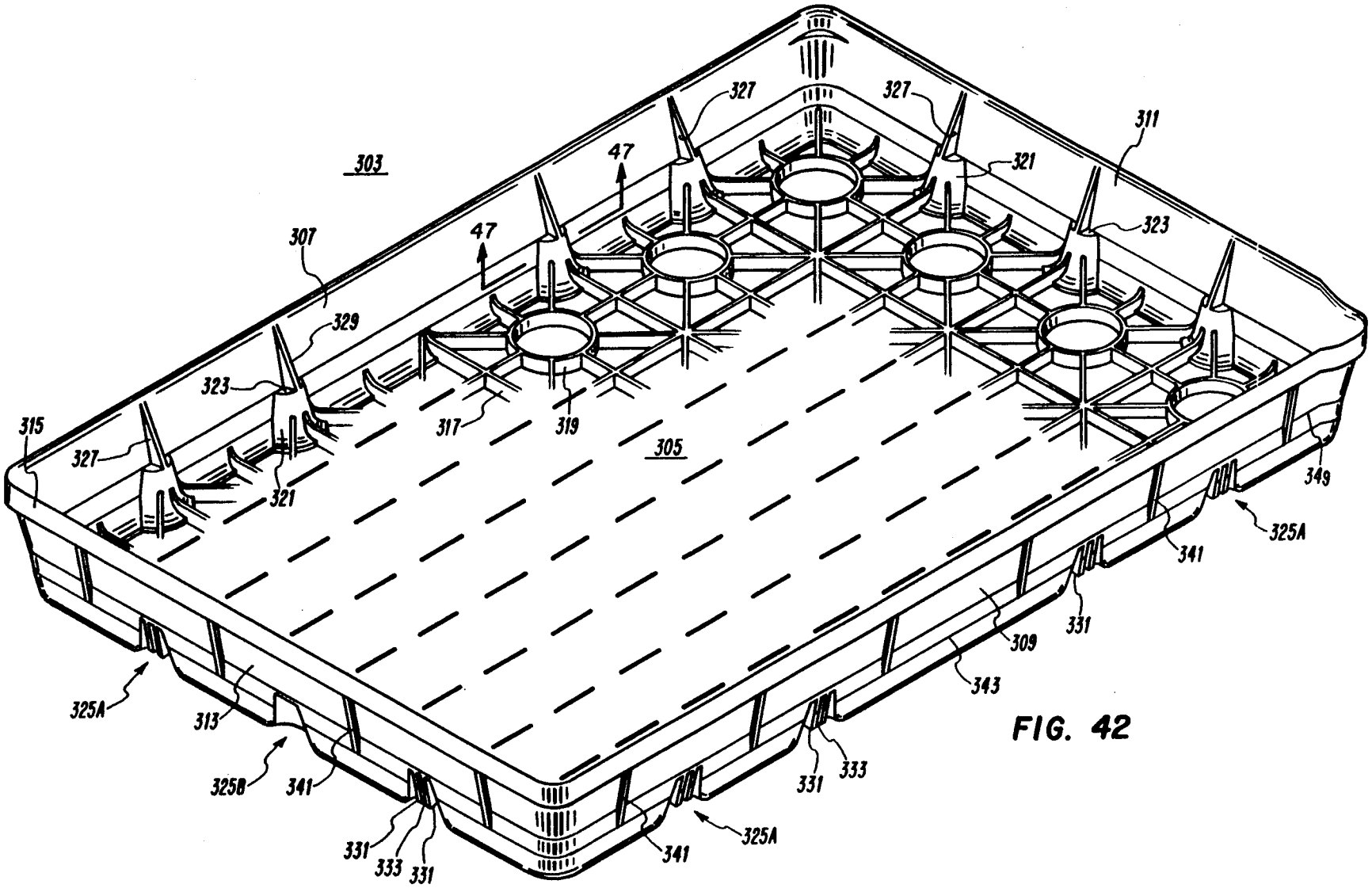
FIG. 42 is a perspective view of a 14th embodiment of a tray, according to the present invention.
Figure 44:
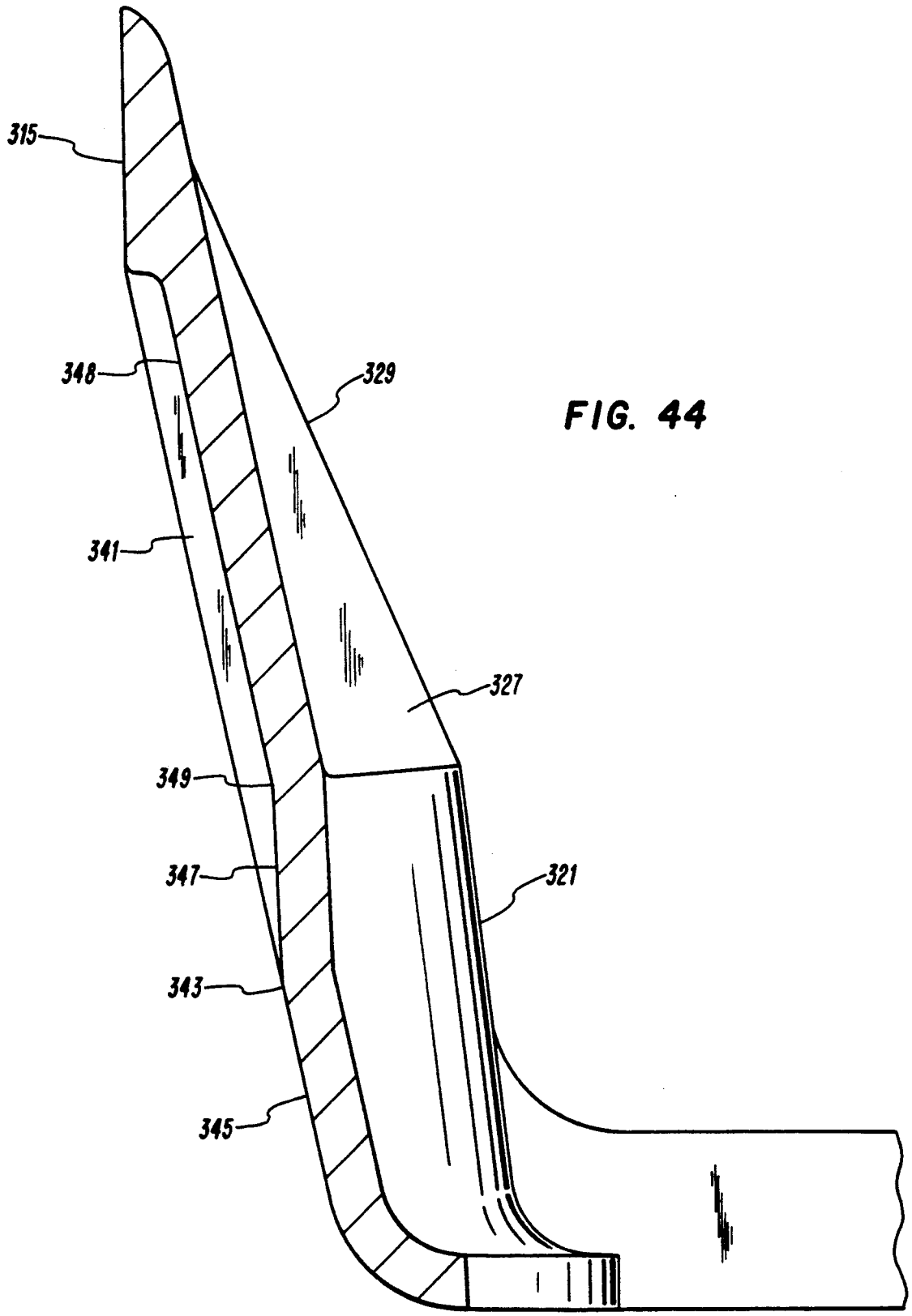
FIG. 44 is a sectional view of the tray of FIG. 42, taken along the line 44—44 in FIG. 43.

As can be best seen in FIG. 42, a plurality of external rib members 341 are disposed on respective outer surfaces of the tray walls to enhance the structural strength and integrity of tray 303. Rib members 341 also help align the respective rim members 315 of the nested trays 303A and 303B along respective vertical axes, as can be best seen in FIGS. 43 and 45, when the walls of outer tray 303B are drawn into contact with the rib members 341 of inner tray 303A. Rib members 341 also provide sufficient spacing between adjacent trays in the nest to prevent the trays from "locking" or sticking together. Rib members 341 have a substantially rectangular shape and extend substantially from rim member 315 downwardly to a position 343 representing an approximate boundary between a lower portion 345 and an intermediate portion 347 of the corresponding tray wall. Referring specifically to FIG. 44, sidewalls 307 and 309 and end walls 311 and 313 of tray 303 are "compound" walls, to allow multiple trays 303 to be nested together when empty, thereby saving storage space. Each wall is comprised of a lower portion 345, an intermediate portion 347 and an upper portion 348. As can be best seen in FIGS. 42 and 44, each support member 321 extends from bottom member 305 to a position 349 representing an approximate boundary 349 between intermediate portion 345 and upper portion 347 of the corresponding compound wall. Boundary 349 defines the approximate depth of penetration of tray 303A within tray 303B when the two trays are nested (also referred to as the "nesting plane"). Similarly, each recess 325A and 325B extends upwardly from bottom member 305 to a position just below boundary 349.

As can be best in FIG. 45, each rib 327 is configured to provide sufficient relief for tray 303A to fully nest within tray 303B, such that the respective bottom surfaces 331A of dividers 331 of tray 303A are positioned in substantially full facing contact with the corresponding support surfaces 323 of tray 303B. In order for trays 303A and 303B to fully nest, the respective bottom surfaces of dividers 331 of tray 303A must contact the corresponding support surfaces 323 of tray 303B before inside surfaces 333 above the respective slots 331 contact inner surfaces 329 of the corresponding ribs 327. When tray 303A is fully nested within tray 303B, rim member 315A of tray 303A is substantially in vertical alignment with the rim member 315B of tray 303B, as can be best seen in FIG. 45.

Each end wall 311 and 313 has one recess 325B which is not partitioned. Each recess 325B is adapted to receive a corresponding rib 327 when a plurality of trays are nested. The space between a wall portion 339 defining the corresponding recess 325B and the corresponding rib 327 is sufficient to accommodate the insertion of an object, to facilitate handling of loaded trays and nested trays.

Figure 47A:
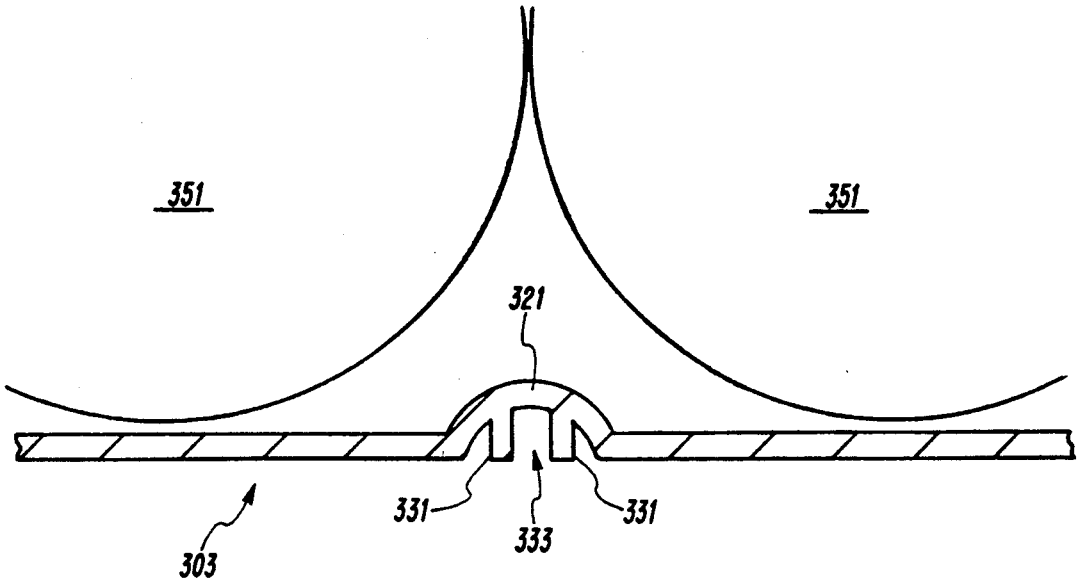
FIGS. 47A and 47B are respective sectional views of the tray, taken along the line 47—47 in FIG. 42, showing beverage containers stored in the tray of FIG. 42 in a "loose" state and in a packaged configuration, respectively.
Figure 47B:
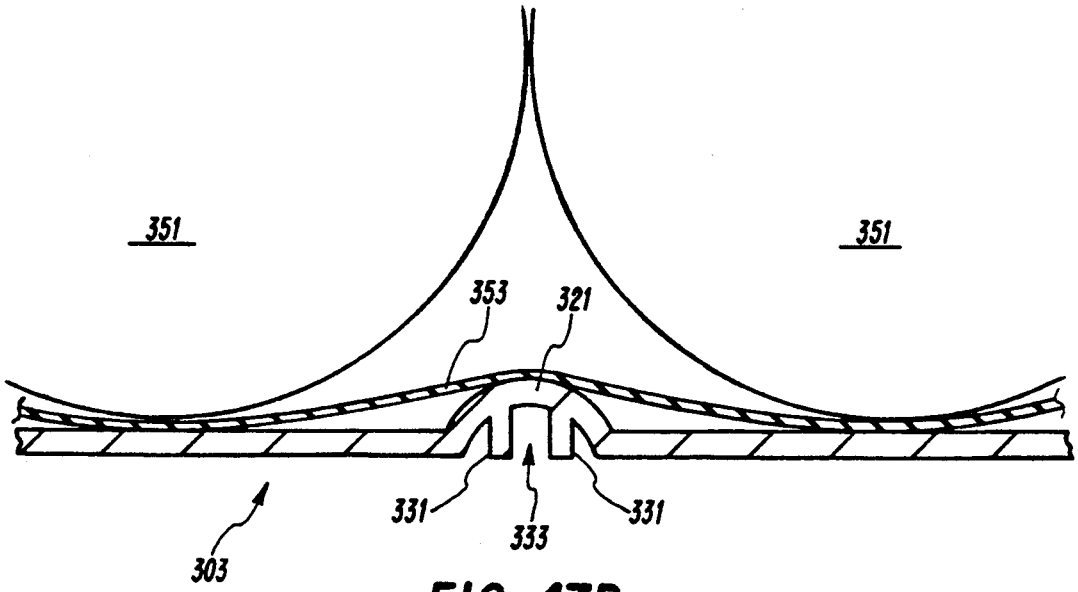

Referring to FIGS. 47A and 47B, a plurality of cylindrically-shaped beverage containers 351 are depicted in an upright position within tray 303. Referring also to FIG. 42, the spacing between adjacent ones of support members 321 is sufficient to allow selected ones of containers 351 adjacent the walls of tray 303 to contact the corresponding walls. The beverage containers 351 can be stored in tray 303 in either a "loose" (unpackaged) condition, as shown in FIG. 47A, or in a multi-container package, in which a plurality of containers 351 (e.g., six or twelve pack containers) are wrapped in a cardboard shroud 353. The cardboard shroud is preferably flexible enough to conform to the approximate contour of the tray walls, including the protruding support members 321, as can be best seen in FIG. 47B. As can be best seen in FIG. 42, tray 303 can accommodate a total of twenty-four individual beverage containers or two twelve-container packs or four six-container packs. When tray 303 is fully loaded, six beverage containers are located adjacent each of the sidewalls 307 and 309 and four beverage containers are located adjacent each of the end walls 311 and 313.

Figure 48:
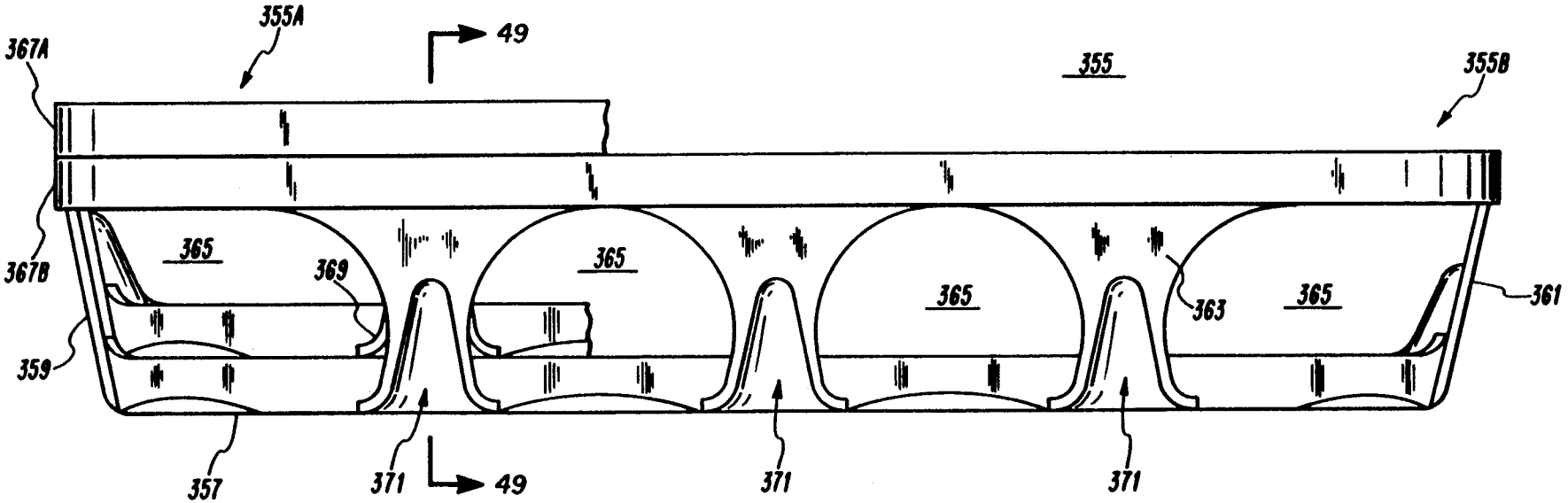
FIG. 48 is an end elevation view of a fifteenth embodiment of a tray, according to the present invention, and a partial end elevation view of another tray, showing the two trays nested.
Figure 49:
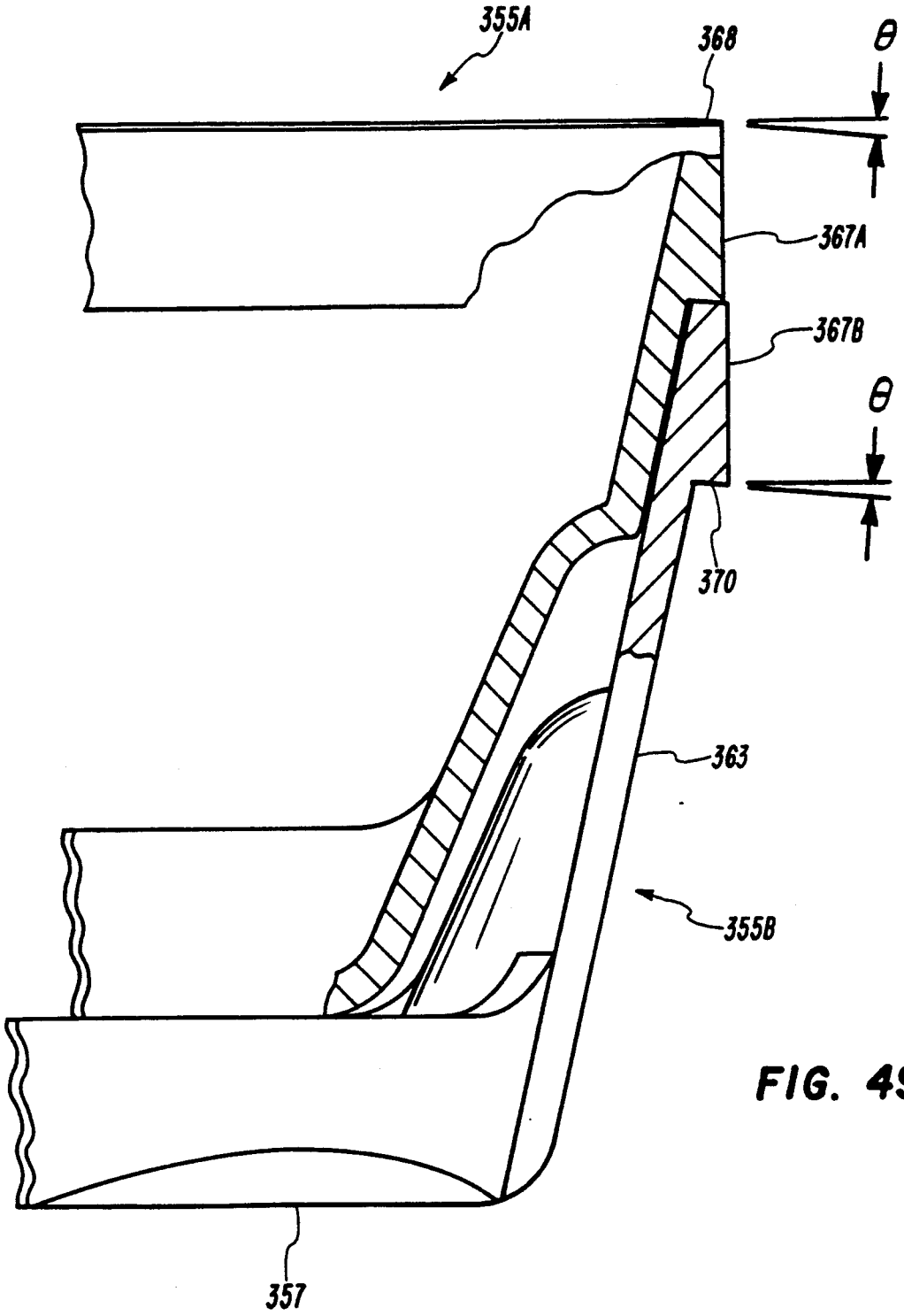
FIG. 49 is a sectional view of the two trays of FIG. 48 in a nested configuration, taken along line 49—49 of FIG. 48.

Referring to FIGS. 48 and 49, a fifteenth embodiment of a tray 355 according to the present invention is depicted. Tray 355 is comprised of a bottom member 357, a pair of oppositely positioned side wall members 359 and 361 and a pair of oppositely positioned end wall members 363 (only one of which is shown in FIGS. 48 and 49), interconnected to form an enclosure for receiving articles therein. Each tray 355 further includes a peripheral rim member 367, extending outwardly from respective top portions of the walls 359, 361 and 363.

Wall members 359, 361 and 363 each have a plurality of substantially vertical rib members 369, extending substantially between bottom member 357 and rim member 367, at spaced intervals on an inner surface of each wall member. Each wall member 359, 361 and 363 is substantially open between adjacent rib members 369 to define of plurality of spaced openings 365. Each rib member 369 has a substantially half-conical shape and defines a corresponding recess 371 on an outer surface of each wall member. When tray 355A is nested within tray 355B, the recesses 371 on the respective outer surfaces of tray 303A matingly engage the respective ribs 369 on the respective inner surfaces of tray 303B. The substantially open portions of the wall members allow tray 355A to be substantially completely received within tray 355B, such that a bottom surface of bottom member 357A of tray 355A rests directly on a top surface of bottom member 357B of tray 355B and rim member 367A of tray 355A rests directly on rim member 367B of tray 355B, as can be best seen in FIG. 48. The open portions of the wall members also allow articles, such as cylindrical beverage containers, stored in the tray to protrude through the open portions of the wall members.

As can be best seen in FIG. 49, rim member 367 has respective top and bottom surfaces 368 and 370, respectively, which are inclined downwardly and outwardly from the corresponding walls of tray 355, at substantially the same angle $\theta$ (e.g., approximately 5°). When multiple trays 355 are nested, the bottom surface 370 of the inner tray rim engages the top surface 368 of the outer tray rim in substantially full surface to surface contact to substantially align the respective rim members 367 of the nested trays along a vertical axis. The weight of the trays above each tray, acting on top surface 368 of each tray draws the walls of each tray inwardly, to prevent the trays (particularly the lowermost trays in the "nest") from collapsing outwardly due to the weight of the trays above.

Figure 50:
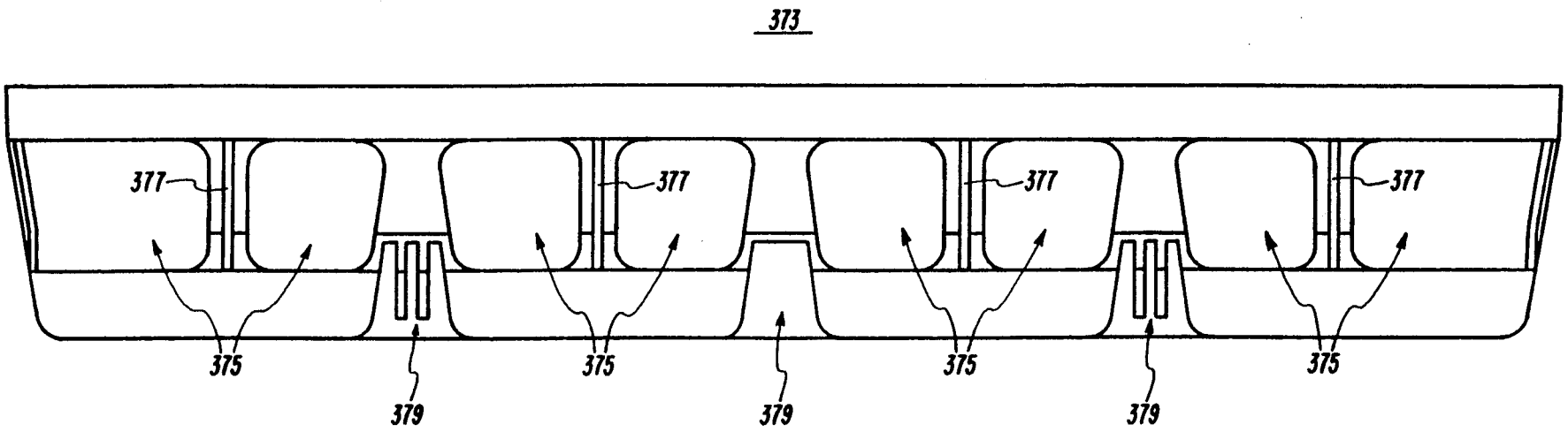
FIG. 50 is an end elevation view of a sixteenth embodiment of a tray, according to the present invention.

Referring to FIG. 50, a sixteenth embodiment of a tray 373 according to the present invention is depicted. Tray 373 is substantially the same as tray 303, which is described above with reference to FIGS. 42–47B, except that substantial portions of each of the walls have been removed to define a plurality of wall openings 375. The portions of the respective walls which are removed to define the respective openings 375 are located between each external rib 377 and an adjacent recess 379. Removing selected portions of the walls, as shown in FIG. 50, will not appreciably affect the strength and structural integrity of tray 373, but will decrease the weight of the tray and reduce the manufacturing cost by reducing the amount of material needed to fabricate the tray.

The tray according to the present invention provides a cost effective, returnable tray for storing and transporting cylindrically shaped articles, such as beverage containers. The tray is lightweight, but sturdy and is able to store and transport beverage containers in either a loose state or in multi-container packages, such as in packages of six, eight or twelve individual containers. The nestability feature of the trays allows multiple trays to be stored in a minimum of storage space when not in use.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. A tray for storing articles in a substantially upright position, said tray having a bottom member and four wall members interconnected to provide an enclosure for receiving the articles, each of said wall members having a predetermined draft angle to allow said bottom member and substantial portions of said wall members of said tray to be received within the enclosure of another tray, whereby a plurality of trays are nestable, each of said wall members having a support member protruding into said enclosure from the corresponding wall member, each support member having an upwardly facing support surface intermediate a top portion of said tray and said bottom member for supporting a bottom member of another tray in an intermediate nested position between said top portion and said bottom member, each of said wall members further including a rib member protruding into said enclosure from the corresponding wall member, each of said rib members extending between said top portion and the corresponding support surface, each of said wall members further including a recess formed in an external surface of the corresponding wall member, each of said recesses extending from said bottom member at least partially upwardly along the corresponding wall member, each of said recesses being adapted to receive a corresponding one of said rib members when two trays are nested, to allow the bottom member of an inner tray in a nested configuration to contact the support surfaces of an outer tray in the nested configuration.

2. The tray of claim 1 wherein each of said support members has a substantially half-conical shape, which is truncated to define the corresponding support surface, each of said rib members being substantially wedge-shaped and extending downwardly and inwardly from said top portion and terminating at the corresponding support surface.

3. The tray of claim 2 wherein selected ones of said recesses each include divider means extending from said bottom member at least partially upwardly along the corresponding wall member for partitioning each of said selected ones of said recesses to form corresponding slots, each of said slots being adapted to receive a corresponding rib member when two trays are nested, each of said rib members having sufficient relief to allow a bottom surface of the corresponding divider means to contact the corresponding support surface.

4. The tray of claim 3 wherein a portion of the corresponding wall member defining each recess other than said selected ones of said recesses is spaced apart from the rib member received within the corresponding recess when two trays are nested, to accommodate the insertion of an object between said portion of the corresponding wall member and the corresponding rib member, to facilitate handling of nested trays.

5. The tray of claim 3 wherein said bottom surface of each of said divider means defines a portion of said bottom member.

6. The tray of claim 3 wherein each of said divider means includes two dividers for dividing the corresponding recess into three portions, an intermediate portion defining the corresponding slot, each of said slots being adapted to receive a corresponding rib member with the corresponding rib member intermediate the two dividers of the corresponding divider means.

7. The tray of claim 1 wherein each of said wall members includes a plurality of support members at predetermined intervals along the corresponding wall member, the support members being spaced along each wall member to accommodate storage of a plurality of substantially cylindrically-shaped articles in a substantially upright position, irrespective of whether the articles are stored separately in the tray or in a package containing a plurality of articles.

8. The tray of claim 7 wherein a portion of each of said wall members is open between adjacent ones of said support members along the corresponding wall member.

9. The tray of claim 1 further including a plurality of spacer members on respective outer surfaces of said wall members, respective inner surfaces of the wall members of the outer tray in the nested configuration being positionable in contact with the corresponding spacer members of the inner tray in the nested configuration, to provide spacing between the inner and outer trays in the nested configuration.

10. The tray of claim 1 wherein each of said support surfaces is inclined upwardly in a direction from the corresponding wall member into said enclosure, a portion of an outer surface of said bottom member proximate to each of said wall members being inclined upwardly in an inward direction, said inclined portion of said bottom member being adapted to contact the corresponding support surfaces of another tray when two trays are nested.

* * * * *